US011421841B2

(12) United States Patent
Baeza

(10) Patent No.: US 11,421,841 B2
(45) **Date of Patent: *Aug. 23, 2022**

(54) FLAME SIMULATOR WITH MOVABLE LIGHT BEAM

(71) Applicant: Lowe's Companies, Inc., Mooresville, NC (US)

(72) Inventor: Guillermo Enrique Baeza, Mooresville, NC (US)

(73) Assignee: LOWE'S COMPANIES, INC., Mooresville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/404,359

(22) Filed: Aug. 17, 2021

(65) Prior Publication Data

US 2021/0372581 A1 Dec. 2, 2021

Related U.S. Application Data

(60) Continuation of application No. 16/817,405, filed on Mar. 12, 2020, now Pat. No. 11,131,436, which is a (Continued)

(51) Int. Cl.
*F21S 10/04* (2006.01)
*F21S 6/00* (2006.01)

(Continued)

(52) U.S. Cl.
CPC ..... *F21S 10/046* (2013.01); *F21S 6/001* (2013.01); *F21S 9/03* (2013.01); *F21V 9/08* (2013.01);

(Continued)

(58) Field of Classification Search
CPC ..... F21S 10/046
See application file for complete search history.

(56) References Cited

U.S. PATENT DOCUMENTS 6,926,423 B2 8/2005 Bucher et al.
7,261,455 B2 8/2007 Schnuckle et al.

(Continued)

FOREIGN PATENT DOCUMENTS

CN 101865413 10/2010
CN 204513249 7/2015

(Continued)

OTHER PUBLICATIONS

U.S. Appl. No. 15/415,214 , Notice of Allowance, dated Mar. 28, 2018, 11 pages.

(Continued)

*Primary Examiner* — Alexander K Garlen
(74) *Attorney, Agent, or Firm* — Kilpatrick Townsend & Stockton LLP

(57) ABSTRACT

A flame simulator includes a light beam source that projects a beam of light, a flame screen, a light beam mover that imparts movement to at least a part of the light beam source, and a range limiter. The light beam source includes a light source adapted to produce light and at least one light conditioner adapted to act on the light from the light source to produce the beam of light with a color, size and shape that mimics a flame when the beam strikes the flame screen. The range limiter is operatively associated with the light beam source so that the beam of light, when being projected, strikes at least a portion of the flame screen and causes illumination of the flame screen by the beam of light.

37 Claims, 16 Drawing Sheets

Related U.S. Application Data continuation of application No. 16/036,601, filed on Jul. 16, 2018, now Pat. No. 10,619,811, which is a division of application No. 15/415,214, filed on Jan. 25, 2017, now Pat. No. 10,030,831.

(60) Provisional application No. 62/286,555, filed on Jan. 25, 2016.

(51) Int. Cl.

| | |
|---|---|
| ***F21S 9/03*** | (2006.01) |
| ***F21V 9/08*** | (2018.01) |
| ***F21V 14/02*** | (2006.01) |
| ***F21V 14/08*** | (2006.01) |
| ***F21V 23/04*** | (2006.01) |
| ***F21V 14/06*** | (2006.01) |
| ***F21W 121/00*** | (2006.01) |
| ***F21Y 115/10*** | (2016.01) |

(52) U.S. Cl.

CPC ..... *F21V 14/02* (2013.01); *F21V 14/08* (2013.01); *F21V 23/0464* (2013.01); *F21V 14/06* (2013.01); *F21W 2121/00* (2013.01); *F21Y 2115/10* (2016.08)

(56) References Cited

U.S. PATENT DOCUMENTS

| | | | |
|---|---|---|---|
| 7,350,720 | B2 | 4/2008 | Jaworski et al. |
| 7,360,935 | B2 | 4/2008 | Jensen et al. |
| 7,503,668 | B2 | 3/2009 | Porchia et al. |
| 7,837,355 | B2 | 11/2010 | Schnuckle |
| 8,070,319 | B2 | 12/2011 | Schnuckle et al. |
| 8,132,936 | B2 | 3/2012 | Patton et al. |
| 8,342,712 | B2 | 1/2013 | Patton et al. |
| 8,408,746 | B1 | 4/2013 | Lauer |
| 8,534,869 | B2 | 9/2013 | Patton et al. |
| 8,550,660 | B2 | 10/2013 | Patton et al. |
| 8,646,946 | B2 | 2/2014 | Schnuckle et al. |
| 8,696,166 | B2 | 4/2014 | Patton et al. |
| 8,721,118 | B2 | 5/2014 | Patton et al. |
| 8,727,569 | B2 | 5/2014 | Schnuckle et al. |
| 8,789,986 | B2 | 7/2014 | Li |
| 8,926,137 | B2 | 1/2015 | Li |
| 9,033,553 | B2 | 5/2015 | Li |
| 9,068,706 | B2 | 6/2015 | Fournier et al. |
| 9,664,349 | B1 | 5/2017 | Hurduc et al. |
| 10,030,831 | B2 | 7/2018 | Baeza |
| 10,054,276 | B1 | 8/2018 | Li |
| 10,619,811 | B2 | 4/2020 | Baeza |
| 11,131,436 | B2 | 9/2021 | Baeza |
| 2008/0129226 | A1 | 6/2008 | DeWitt et al. |
| 2008/0130266 | A1 | 6/2008 | DeWitt et al. |
| 2011/0019422 | A1 | 1/2011 | Schnuckle et al. |
| 2011/0127914 | A1 | 6/2011 | Patton et al. |
| 2013/0003385 | A1 | 1/2013 | Chartrand et al. |
| 2013/0070446 | A1 | 3/2013 | Chen |
| 2014/0098532 | A1 | 4/2014 | Chiang |
| 2014/0177212 | A1 | 6/2014 | Li |
| 2014/0218903 | A1 | 8/2014 | Sheng |
| 2014/0254148 | A1 | 9/2014 | Fournier |
| 2014/0268652 | A1 | 9/2014 | Li |
| 2015/0204530 | A1 | 7/2015 | Lee |
| 2015/0354769 | A1 | 12/2015 | Patton et al. |
| 2016/0109083 | A1 | 4/2016 | Li |
| 2016/0153630 | A1 | 6/2016 | Dong |
| 2016/0290579 | A1 | 10/2016 | Au et al. |
| 2016/0312969 | A1 | 10/2016 | Patton |
| 2017/0167677 | A1 | 6/2017 | Patton et al. |
| 2017/0211767 | A1 | 7/2017 | Baeza |
| 2017/0234496 | A1 | 8/2017 | Wang |
| 2019/0063703 | A1* | 2/2019 | Hurduc ..... F21V 14/06 |

FOREIGN PATENT DOCUMENTS

| | | |
|---|---|---|
| CN | 204962604 | 1/2016 |
| EP | 2899452 | 7/2015 |
| WO | 2015021066 | 2/2015 |
| WO | 2015061623 | 4/2015 |
| WO | 2017132224 | 8/2017 |

OTHER PUBLICATIONS

U.S. Appl. No. 15/415,214 , "Restriction Requirement", dated Dec. 20, 2017, 6 pages.
U.S. Appl. No. 16/036,601 , Non-Final Office Action, dated Aug. 14, 2019, 15 pages.
U.S. Appl. No. 16/036,601 , Notice of Allowance, dated Dec. 11, 2019, 8 pages.
U.S. Appl. No. 16/817,405 , Final Office Action, dated Feb. 5, 2021, 15 pages.
U.S. Appl. No. 16/817,405 , Non-Final Office Action, dated Aug. 10, 2020, 6 pages.
U.S. Appl. No. 16/817,405 , Notice of Allowance, dated May 28, 2021, 9 pages.
Application No. CA3,011,599 , Notice of Allowance, dated Apr. 1, 2020, 1 page.
Application No. CA3,011,599 , Office Action, dated May 7, 2019, 4 pages
Application No. CN201780019609.5 , Office Action, dated Dec. 19, 2019, 10 pages.
Application No. CN201780019609.5 , Office Action, dated Jun. 17, 2019, 14 pages.
Application No. CN201780019609.5 , Office Action, dated Nov. 2, 2020, 7 pages.
Application No. CN201780019609.5 , Office Action, dated Apr. 20, 2020, 8 pages.
Application No. PCT/US2017/014879 , International Preliminary Report on Patentability, dated Aug. 9, 2018, 9 pages.
Application No. PCT/US2017/014879 , International Search Report and Written Opinion, dated Mar. 24, 2017, 14 pages.
Application No. CN202110187776.9 , Office Action, dated Sep. 8, 2021, 40 pages.

* cited by examiner

FLAME SIMULATOR WITH MOVABLE LIGHT BEAM

CROSS-REFERENCES TO RELATED APPLICATIONS

This application is a continuation application of U.S. patent application Ser. No. 16/817,405, which is a continuation of U.S. patent application Ser. No. 16/036,601, filed Jul. 16, 2018, now issued U.S. Pat. No. 10,619,811, issued Apr. 14, 2020, which is a divisional of U.S. patent application Ser. No. 15/415,214, filed Jan. 25, 2017, now issued U.S. Pat. No. 10,030,831, issued Jul. 24, 2018, which application claims the benefit of U.S. Provisional Patent Application No. 62/286,555, filed Jan. 25, 2016, the entire contents of which are hereby incorporated by reference in their entirety.

BACKGROUND

The present invention relates to a flame simulator with a movable light beam.

Prior examples of flame simulators are disclosed in the following U.S. Pat. Nos.:

| | | | | |
|---|---|---|---|---|
| 7,261,455 | 8,727,569 | 8,721,118 | 8,646,946 | 8,696,166 |
| 8,132,936 | 8,342,712 | 8,534,869 | 8,070,319 | 7,837,355 |
| 8,789,986 | 8,926,137 | 8,550,660 | | |

The flame simulators disclosed in some of the foregoing patents include a flame silhouette upon which a beam of light is projected. The illuminated portion of the flame silhouette (i.e., the beam spot) simulates a flame. The flame silhouette is forced to move by an actuator mechanism (e.g., electro-magnetic). This movement of the flame silhouette causes changes in position and shape of a light spot on the flame silhouette and simulates a flame flicker. However, the entire flame silhouette moves—not just the portion that is illuminated by the beam of light. The unlit portions of the flame silhouette, especially its edges, are noticeable when the ambient lighting of a room allows it to be seen. The movement of the unlit portions and edges make the flame silhouette even more noticeable and more distracting (and more artificial-looking) than would be the case if the flame silhouette remained stationary. A stationary flame silhouette is less noticeable and distracting than a moving one. A need therefore exists for a flame simulator that simulates dancing of a flame but does not require the flame silhouette to move.

Another example of a flame simulator in the aforementioned patents uses multiple light sources to illuminate different surfaces of a flame silhouette and simulate movement of the flame by independently varying the intensity of light provided be each source. This approach, however, cannot be implemented using a single light source and the flame simulation is not as realistic as when a single spot of light moves and changes shape.

BRIEF SUMMARY

A flame simulator comprises a light beam source, a flame screen, a light beam mover and a range limiter. The light beam source is adapted to project a movable beam of light. The flame screen is arranged with respect to the light beam source so that, when the light beam source projects the movable beam of light, at least a portion of the movable beam of light strikes the flame screen. The light beam mover is operatively associated with the light beam source and adapted to impart movement to at least part of the light beam source. The range limiter is operatively associated with the light beam source and adapted to limit movement of the light beam source and the movable beam of light so that the movable beam of light, when being projected, strikes at least a portion of the flame screen and causes illumination of the flame screen by the beam of light to resemble a flame.

The light beam mover and the range limiter can be configured so that movement of the light beam by the light beam mover causes changes in an angle of illumination and a position of illumination of the flame screen and/or so that the changes in angle and position of illumination result in changes to the shape of the illumination of the flame screen.

The light beam source can comprise a light source adapted to produce light and at least one light conditioner adapted to act on the light from the light source to produce the beam of light with a color, size and shape that mimics a flame when the beam strikes the flame screen. The light beam mover can be configured to move the light source while at least one light conditioner remains stationary, can be configured to move at least one light conditioner while the light source remains stationary, or can be configured to move the at least one light conditioner and the light source.

The shape of the flame screen and a range of angles of the beam with respect to the flame screen can be configured so that the illumination of the flame screen by the beam results in rounded, flame-shaped light projection on the flame screen.

The light beam mover and the range limiter can be configured so that movement of the beam in response to the light beam mover causes changes in the shape and position of illumination of the flame screen by the beam which mimic movement of a flame exposed to ambient air currents.

The light beam source can be adapted to produce a yellowish beam of light with a shape, intensity and color that result in a candle flame-mimicking illumination of the flame screen. The light beam source can be adapted to produce the beam of light with a correlated color temperature in a range between 1,800 Kelvin and 1,900 Kelvin, or with a correlated color temperature in a range between 1,650 Kelvin and 2,300 Kelvin.

The flame screen can be adapted to remain stationary when the light beam mover imparts movement to the at least part of the light beam source.

The flame simulator can further comprise a housing that resembles a candle. The flame screen can project upwardly from an upper surface of the housing. The light beam source can be located in the housing and no higher than the upper surface of the housing so that the light beam source is not visible when the housing is viewed from a location that is laterally separated from the housing.

The light beam mover can comprise a magnetic field generator adapted to produce a magnetic field that varies and causes at least part of the light beam source to move.

The light beam mover can comprise an air mover adapted to generate at least one air current that causes movement of at least part of the light beam source.

The light beam mover can comprise a motor and a mechanical coupling from the motor to at least part of the light beam source.

The light beam source can include a light source adapted to generate light and at least one light conditioner adapted to produce the beam of light using light from the light source and to direct the light at the flame screen, and the light beam mover can be operatively associated with the light source to impart movement to the light source. The at least one light conditioner can be adapted to remain stationary when the light beam mover imparts movement to the light source. The light beam mover, alternatively, can be operatively associated with the light beam source and adapted to impart movement to the light beam source.

The flame simulator can further comprise a flame simulator body and an anchor fixed to the flame simulator body. The flame simulator can further comprise a ball-and-socket coupling between the light beam source and the anchor. The ball-and-socket coupling can constitutes at least part of the range limiter. The anchor can extend downwardly from an upper wall of the flame simulator body.

The flame simulator can further comprise a connector adapted to connect the light beam source to the anchor, wherein the connector and anchor constitute at least part of the range limiter.

An imitation candle comprises a candle body and at least one flame simulator. The candle body, when resting upright on a surface, can visually resemble a wax candle. The at least one flame simulator can be located partially inside the candle body. Each flame simulator can comprise a light beam source, a flame screen, a light mover, and a range limiter. The light beam source can be adapted to project a movable beam of light. The flame screen can be arranged with respect to the light beam source so that, when the light beam source projects the movable beam of light, at least a portion of the movable beam of light strikes the flame screen. The light beam mover can be operatively associated with the light beam source and adapted to impart movement to at least part of the light beam source. The range limiter can be operatively associated with the light beam source and adapted to limit movement of the light beam source and the movable beam of light so that the movable beam of light, when being projected, strikes at least a portion of the flame screen and causes illumination of the flame screen by the beam of light to resemble a flame.

The candle body can comprise an upper surface, and each flame screen can be located at the upper surface and extend upwardly from the upper surface. The imitation candle can further comprise at least two of the at least one flame simulator arranged so that the flame screen of one flame simulator is laterally spaced apart from each other flame screen, to simulate a candle having multiple burning wicks. Each light beam mover and each range limiter can be configured so that movement of each movable beam of light in response to a corresponding one of the light beam movers causes changes in a corresponding illumination of a corresponding one of the flame screens that mimic movement of a flame exposed to ambient air currents.

Each light beam mover and each range limiter can be configured so that movement of each movable beam of light in response to a corresponding one of the light beam movers causes changes in shape and position of a corresponding illumination of a corresponding flame screen by the corresponding beam of light.

Each light beam source can be adapted to produce a yellowish beam of light with a shape, intensity and color that result in a candle flame-mimicking illumination of a corresponding flame screen.

An imitation candle can comprise a candle body, a candle holder, a power supply circuit, and at least one flame simulator. The candle body can visually resemble a wax candle. The candle holder can be adapted to support the candle body. The power supply circuit can be housed at least partially inside at least one of the candle holder or the candle body, and can be adapted to provide electrical power to the at least one flame simulator. The at least one flame simulator can be located partially inside the candle body and can comprise a light beam source, a flame screen, a light beam mover, and a range limiter. The light beam source is adapted to project a movable beam of light. The flame screen can be arranged with respect to the light beam source so that, when the light beam source projects the movable beam of light, at least a portion of the movable beam of light strikes the flame screen. The light beam mover can be operatively associated with the light beam source and can be adapted to impart movement to at least part of the light beam source. The range limiter can be operatively associated with the light beam source and adapted to limit movement of the light beam source and the movable beam of light so that the movable beam of light, when being projected, strikes at least a portion of the flame screen and causes illumination of the flame screen by the beam of light to resemble a flame.

The power supply can include a solar panel adapted to convert light energy into electrical energy, and an energy storage battery adapted to store electrical power from the solar panel and supply the electrical power to the at least one flame simulator when the at least one simulator is activated. The solar panel can be located on the candle holder.

DETAILED DESCRIPTION

Figure 1:
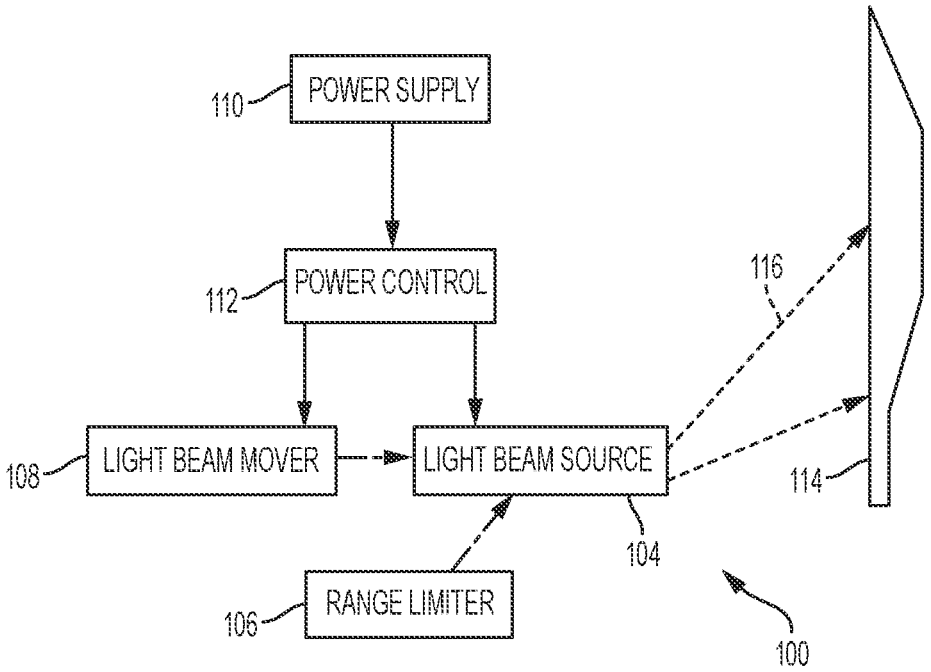
FIG. 1 is a block diagram of a flame simulator according to an embodiment of the present invention.

FIG. 1 is a block diagram of a flame simulator 100 according to an embodiment of the present invention. The flame simulator 100 comprises a light beam source 104, a range limiter 106, a light beam mover 108, a power supply 110, a power control circuit 112 (hereinafter "power controller"), and a flame screen 114. The light beam source 104 can be adapted to project a movable beam 116 of light with a circular, oval, elliptical, or otherwise round, cross-sectional shape.

Figure 2:
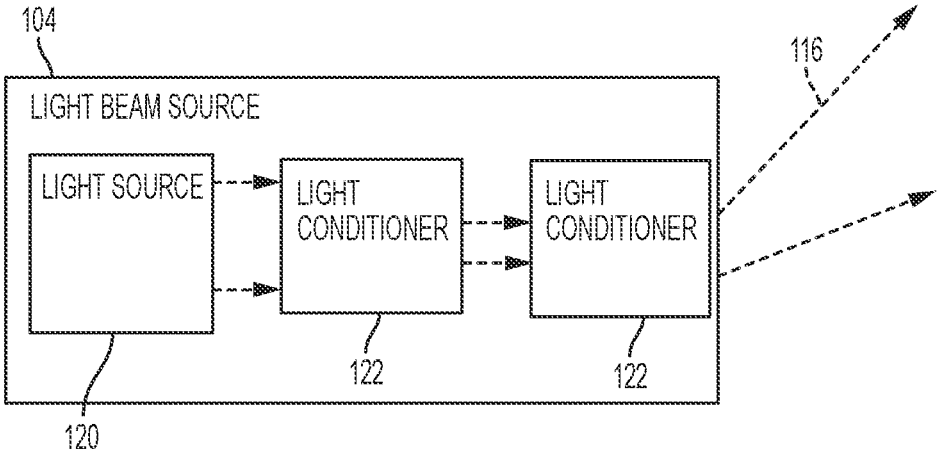
FIG. 2 is a block diagram of a light beam source according to an embodiment of the present invention.

As shown in the block diagram of FIG. 2, the light beam source 104 can include a light source 120 and one or more light conditioners 122. The light conditioner(s) 122 can be lenses, filters (e.g., color filters), or other optical elements that act on the light from the light source 120 to a project the beam 116 with an intensity, shape and/or color that mimics a flame (e.g., a candle flame) when the beam 116 strikes the flame screen 114.

The light source 120 can be implemented using a light emitting diode ("LED"), an incandescent bulb, or any other source of light capable of emitting light with a quality, intensity, shape and/or color that the light conditioner(s) 122 can convert into a beam 116 that mimics a flame (e.g., a candle flame) when the beam 116 strikes the flame screen 114. Alternatively, the light beam source 104 can be implemented using a light source 120 that, without utilizing any distinct light conditioners 122, is configured to generate the beam 116 with a suitable quality, intensity, and color of light and with a round cross-sectional shape.

The flame screen 114 is arranged with respect to the light beam source 104 so that, when the light beam source 104 is turned on and projects the movable beam 116 of light, at least a portion of the movable beam 116 strikes the flame screen 114. The shape of the flame screen 114 and the angle of the beam 116 with respect to the flame screen 114 are selected so that the illumination provided by the beam 116 results in rounded, flame-shaped light projection on the flame screen 114.

The light beam mover 108 can be operatively associated with the light beam source 104 and adapted to impart movement to at least part of the light beam source 104. This movement causes movement of the beam 116. This movement of the beam 116, in turn, causes changes in the angle of illumination and the position of illumination of the flame screen 114, and as a result of those changes, the shape of the illumination of the flame screen 114 and its position on the flame screen 114 changes. The light beam mover 108 can be configured to move the light source 120 while one or more of the light conditioners 122 remain stationary, can be configured to move one or more of the light conditioners 122 while the light source 120 remains stationary, or can be configured to move the entire light beam source 104 to effect movement of the beam 116.

A range limiter 106 can be operatively associated with the light beam source 104 and adapted to limit movement of the light beam source 104 (or movement of the light source 120 or light conditioners 122 thereof) and the movable beam 116 so that the beam 116 of light, when projected, strikes at least a portion of the flame screen 114 and causes illumination of the flame screen 114 by the beam 116 to resemble a flame. The light beam mover 108 and the range limiter 106 can be configured so that movement of the movable beam 116 in response to the light beam mover 108 causes changes in the shape and position of the illumination of the flame screen 114 by the beam 116. Such changes in the illumination of the flame screen 114 can be made to mimic movement of a flame exposed to ambient air currents. The light beam mover 108 can generate the beam movement and the range limiter 106 can limit the range of movement so that the beam 116 stays mostly on the flame screen 114 in a region bounded by the typical range of movement of the flame being simulated (e.g., a candle flame moving in response to ambient air currents). The light beam mover 108 can cause the illumination provided by the beam 116 to dance on the flame screen 114 with variations in position and shape that mimic a dancing flame (e.g., a candle flame being blown about by air currents).

The variations in illumination that mimic a dancing flame also can be controlled by providing the flame screen 114 with a concave surface that faces the beam 116. The curvature of the concave surface can be determined based on the range of the beam's 116 motion and based on the cross-sectional shape and size of the beam 116, to result in an illumination spot that looks like a flame (e.g., a candle flame). The flame screen 114 can be fixedly mounted so that it remains stationary while the beam 116 of light moves in response to the light beam mover 108.

The light beam source 104 can be adapted to produce a yellowish beam of light with a shape, intensity and color that result in a candle flame-mimicking illumination of the flame screen 114. The shape, intensity and color can be provided by the light source 120 itself, or by a combination of the light source 120 and the light conditioner(s) 122. For example, the light source 120 can be configured to emit unfocussed light with a color that is whiter than the color of a candle flame. The light conditioners 122 can cooperate to impart a yellowish color (e.g., using color filtering in one light conditioner 122) and focus (or otherwise shape) the light (e.g., using one or more other light conditioners 122) into the beam 116 so that the beam's illumination of the flame screen 114 resembles a flame. The light beam source 104 alternatively can be configured to have a single light conditioner 122 that imparts the desired color, shape and quality to the light beam 116 so that the beam's illumination of the flame screen 114 resembles a flame.

According to one embodiment of the invention, the light beam source 104 is adapted to produce the beam 116 of light with a correlated color temperature in a range between 1,800 Kelvin and 1,900 Kelvin. According to another embodiment, the light beam source 104 is adapted to produce the beam 116 of light with a correlated color temperature in a range between 1,650 Kelvin and 2,300 Kelvin.

Figure 3:
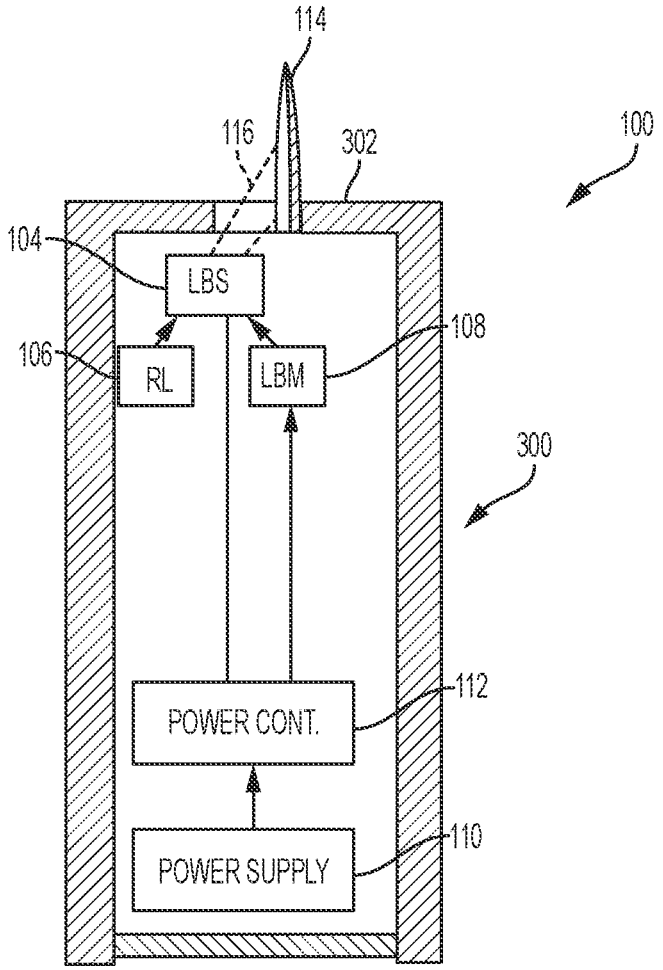
FIG. 3 is a schematic block diagram and cross-sectional view of a flame simulator according to an embodiment of the present invention.

FIG. 3 schematically shows an embodiment of the flame simulator 100 that comprises a housing/candle body 300 that, when resting upright on a surface, visually resembles a wax candle. The flame simulator 100 can be located partially inside the candle body (or housing) 300. The flame screen 114 can be mounted so that it extends upwardly from an upper surface 302 of the housing 300. The light beam source 104 is located in the housing 300 and need not extend higher than the upper surface 302 of the housing 300 so that the light beam source 104 is not visible when the housing 300 is viewed from a location that is laterally separated from the housing 300 (e.g., as viewed in a horizontal direction from across a room). Since the light beam mover 108 is adapted to impart movement to the light beam 116, the flame screen 114 can be fixedly mounted (e.g., to the housing 300) and can remain stationary while movement of the beam 116 on the flame screen 114 simulates movement of a candle flame under the influence of varying air currents.

The light beam mover 108 can be implemented using any suitable mechanism for moving the light beam 116. The light beam mover 108, for example, can comprise a magnetic field generator adapted to produce a magnetic field that varies over time and causes at least part of the light beam source 104 to move. A magnetically responsive element (e.g., an earth magnet) can be connected to (or otherwise associated with) the light beam source 104 so that, when the magnetic field varies, a force is applied to the magnetically responsive element and causes the magnetically responsive element to move. By providing a suitable coupling between the magnetically responsive element and the light beam source 104, this movement of the magnetically responsive element can be transferred directly or indirectly to the light beam source 104 and cause the light beam source 104 or a component thereof (e.g., the light source 120, one or more of the light conditioners 122, or both) to move. This movement, in turn, causes the beam 116 to move.

According to another embodiment of the invention, the light beam mover 108 comprises an air mover (e.g., a fan) adapted to generate at least one air current that impinges upon the light beam source 104 (or a component of the light beam source 104) and/or impinges on an air current-responsive element that moves in response to the air current. The air current-responsive element can be coupled directly or indirectly to the light beam source 104 (or part of the light beam source 104) so that movement of the air-current-responsive element causes the light beam source 104 or a component thereof (e.g., the light source 120, one or more of the light conditioners 122, or both) to move. This movement, in turn, causes the beam 116 to move.

According to another embodiment of the invention, the light beam mover 108 comprises a motor and a coupling from the motor directly or indirectly to at least part of the light beam source 104. The coupling moves in response to activation of the motor and causes the light beam source 104 or a component thereof (e.g., the light source 120, one or more of the light conditioners 122, or both) to move. This movement, in turn, causes the beam 116 to move.

The coupling to the motor can be implemented using any coupling structure that converts the mechanical motion of the motor into movement of the light beam source 104 or a component thereof (e.g., the light source 120, one or more of the light conditioners 122, or both) with a frequency, speed and range (limited by the range limiter 106) that causes the illumination of the flame screen 114 by the beam 116 to resemble a flame moving in response to air currents. The coupling can include flexible components, rigid components, or a combination of flexible and rigid components. The coupling also can be implemented using one or more non-mechanical couplings (e.g., one or two magnets that are rotated or otherwise moved by the motor and that impart motion onto a magnetically responsive element coupled directly or indirectly to the light beam source 104, or a component of the light beam source 104). The coupling also can be implement using an intermittent coupling, which exerts a movement force on the light beam source 104 (or a component thereof) momentarily, releases it momentarily so that the light beam source 104 (or a component thereof) moves back toward a previous orientation, and repeatedly applies and releases the force so that the beam 116 appears to dance like a flame on the surface of the flame screen 114.

Figure 4:
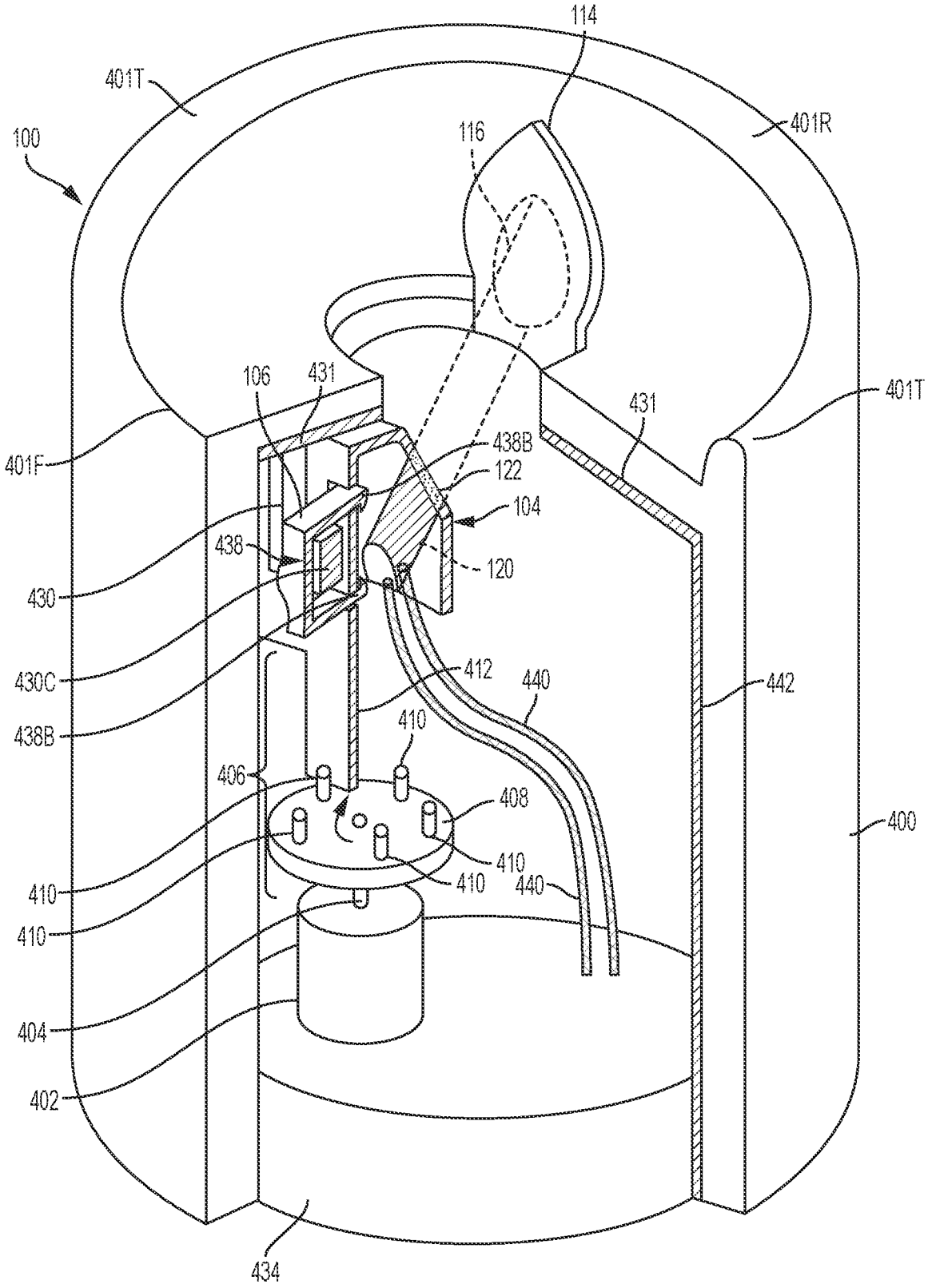
FIG. 4 is a three-quarter cross-sectional perspective view of a flame simulator according to an embodiment of the present invention.

FIG. 4 shows an embodiment of the flame simulator 100 with a housing 400 that resembles a candle. Part of the flame simulator 100 and its housing 400 have been omitted in the three-quarter cross-sectional view of FIG. 4 so that internal components of the flame simulator 100 can be seen. Behind the flame screen 114, the housing 400 can have a top edge portion 401R that extends higher up than a top edge portion 401F located in front of the flame screen 114. A top edge transition portion 401T can be inclined upwardly from the front top edge portion 401F to the rear top edge portion 401R. The incline of the transition portion 401T can be constant from front to rear, or can vary from front to rear to simulate variations in candle-top melting. The top edge portion 401R behind the flame screen 114 can be configured to extend at least as high as the flame screen 114 (or higher) so that the flame screen is not visible from behind when the housing 400 is viewed horizontally from behind (e.g., viewed from behind, horizontally across a room).

In the embodiment of FIG. 4, the light beam mover 108 comprises a motor 402 with a rotatable output shaft 404 and a coupling 406 from the motor 402 to at least part of the light beam source 104. The coupling 406 moves in response to activation of the motor 402 and causes the light beam source 104 (or alternatively, a component thereof) to move. This movement, in turn, causes the beam 116 to move.

The coupling 406 to the motor 402 includes a rotatable actuator 408 configured to rotate with the output shaft 404 of the motor 402. The rotatable actuator 408 includes several pushers 410 (e.g., pegs, teeth or other projections). As the actuator 408 rotates, the pushers 410 sequentially come into contact with a beam source extension 412. The beam source extension 412 is connected to the light beam source 104 and causes movement of the light beam source 104 when the extension 412 moves. Each pusher 410 sequentially pushes the extension 412, moves past the extension 410, and thus releases the extension 410 so that it can swing back (e.g., in response to gravitational force) toward a starting orientation. The starting orientation can be an orientation that centers the beam 116 laterally on the flame screen 114. The coupling 406 thereby converts the mechanical motion of the motor 402 into movement of the light beam source 104 or a component thereof (e.g., the light source 120, one or more of the light conditioners 122, or both) with a frequency, speed and range (limited by the range limiter 106) that causes the illumination of the flame screen 114 by the beam 116 to resemble a flame moving in response to air currents.

The coupling 406 can include flexible components, rigid components, or a combination of flexible and rigid components. In this regard, the actuator 408, the pushers 410 and/or the extension 412 can be flexible, rigid or a combination of flexible and rigid. The determination of which aspects of the coupling 406 are flexible or rigid and how flexible and rigid they are, can be made based on whether that combination causes the beam's movement to realistically simulate flame movement in response to the rotational speed of the actuator 408.

If the motor's speed of rotation is too fast for direct mounting of the actuator 408 to the shaft 404, the output shaft 404 can be connected to gearing that converts the fast rotation of the shaft 404 into rotation of the actuator 40 at a speed slow enough to provide the aforementioned a frequency, speed and range (limited by the range limiter 106)

of beam source 104 movement that causes the illumination of the flame screen 114 by the beam 116 to resemble a flame moving in response to air currents. Another technique for controlling movement of the beam source 104 is by selecting suitable number of pushers 410, suitable spacing and sizes of the pushers 410, suitable dimensions of the actuator 408 and the extension 412, and suitably configuring the range limiter 106.

Figure 5:
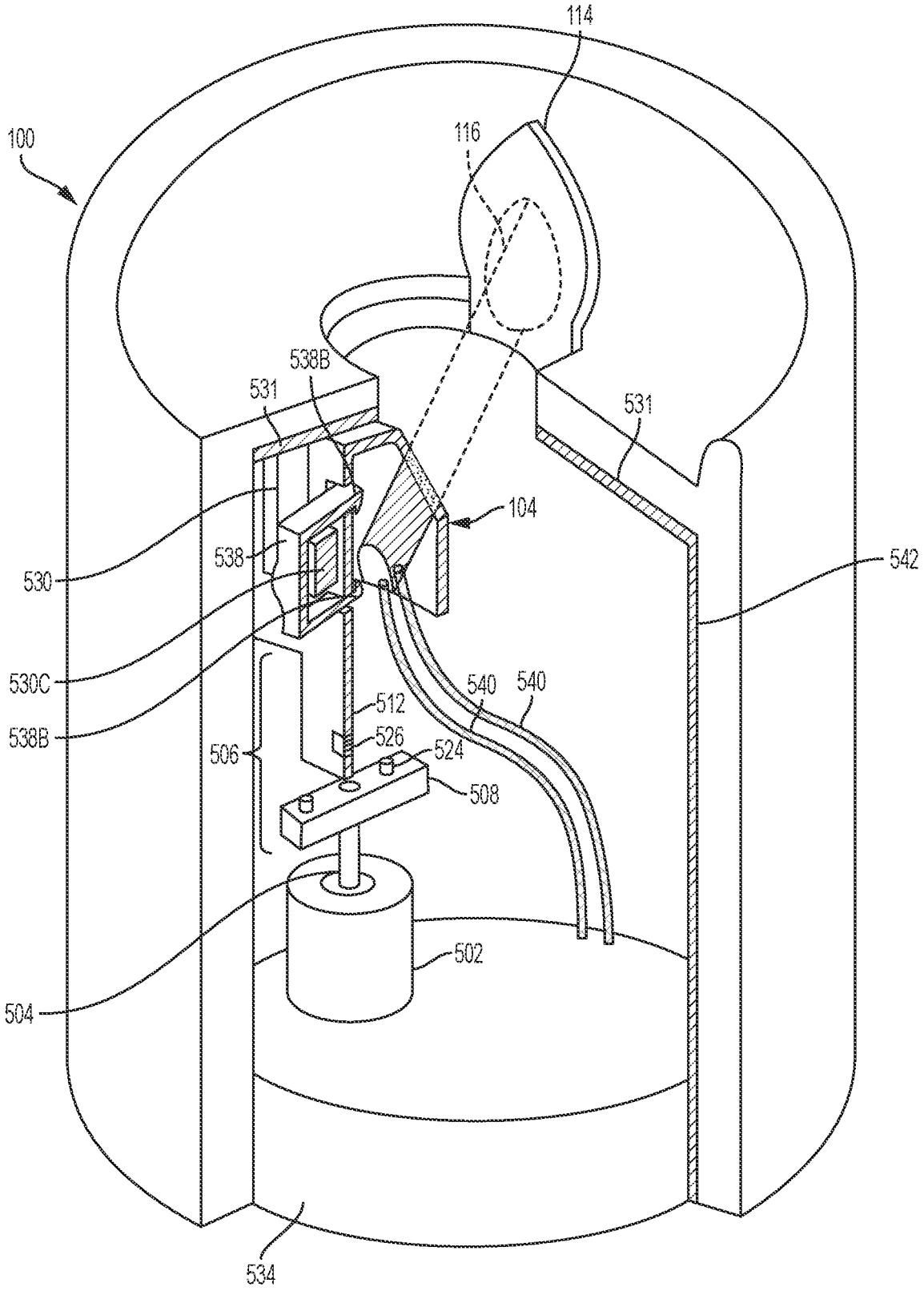
FIG. 5 is a three-quarter cross-sectional perspective view of a flame simulator according to an embodiment of the present invention.

FIG. 5 shows an example of the flame simulator 100 where the coupling 506 is implemented using one or more non-mechanical couplings (e.g., one or two magnets 524 that are rotated or otherwise moved by the motor 502 and that impart motion onto a magnetically responsive element 526 coupled directly or indirectly to the light beam source 104, or to a component of the light beam source 104). In the example of FIG. 5, actuator 508 rotates in response to rotation of the motor shaft 504. The rotation of the actuator 508 causes the magnet(s) 524 to move in a circle. This circular movement changes the position of the magnets 524 with respect to the magnetically responsive element 526 (e.g., another magnet) and results in variations in magnetic force applied to the magnetically responsive element 526. Those variations cause the extension 512 to move (e.g., wiggle), and as a result, the light beam source 104 (or a component thereof) moves (e.g., wiggles) so that the beam 116 appears to dance like a flame on the surface of the flame screen 114.

Figure 6:
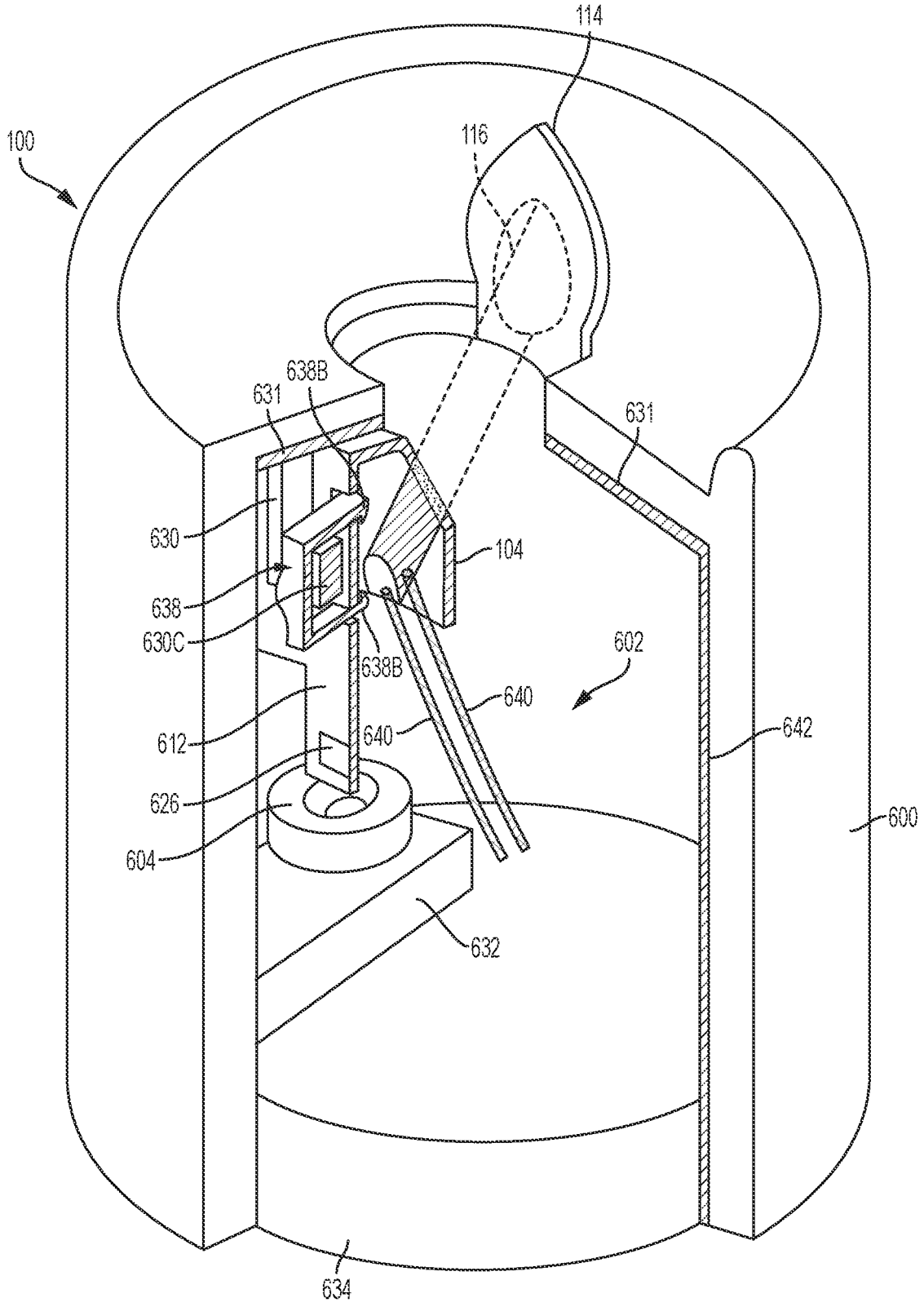
FIG. 6 is a three-quarter cross-sectional perspective view of a flame simulator according to an embodiment of the present invention.

FIG. 6 shows an embodiment of the flame simulator 100 with a housing 600 that resembles a candle. Part of the flame simulator 100 and its housing 600 have been omitted in the three-quarter cross-sectional view of FIG. 6 so that internal components of the flame simulator 100 can be seen. In the embodiment of FIG. 6, the light beam mover 108 comprises a magnetic field generator 602 adapted to produce a magnetic field that varies over time and causes at least part of the light beam source 104 to move. A magnetically responsive element 626 (e.g., an earth magnet) can be connected to (or otherwise associated with) the light beam source 104 so that, when the magnetic field varies, a force is applied to the magnetically responsive element 626 and causes the magnetically responsive element 626 to move. By providing a suitable coupling (e.g., extension 612) between the magnetically responsive element 626 and the light beam source 104, this movement of the magnetically responsive element 626 can be transferred directly or indirectly to the light beam source 104 and cause the light beam source 104 or a component thereof (e.g., the light source 120, one or more of the light conditioners 122, or both) to move (e.g., wiggle). This movement, in turn, causes the beam 116 to move (e.g., wiggle).

The magnetic field generator 602 can comprise an electrical coil 604 which is electrically connected to a source of varying electrical voltage. Alternatively, multiple coils can be utilized. The varying electrical voltage creates variations in electrical current in each coil 604, and the varying current produces a varying magnetic field. The varying magnetic field acts on the magnetically responsive element 626 and forces the extension 612 to move (e.g., wiggle). This causes the light beam source 104 (or alternatively, a component thereof) to move (e.g., wiggle). This movement, in turn, causes the beam 116 to move (e.g., wiggle). The number of windings in the coil 604 and the magnitude and variations of the voltage are selected so that the variations and strength of the magnetic field cause the extension 612 to move (e.g., wiggle) with a frequency, speed and range (limited by the range limiter 106) that causes the illumination of the flame screen 114 by the beam 116 to resemble a flame moving (or dancing) in response to air currents.

Circuitry for producing the varying electrical voltage can be housed in a circuit housing 632 or alternatively can be placed on an exposed circuit board inside the housing 600. The varying electrical voltage can be cyclic (repeating) or can be random. The varying electrical voltage can be a sinusoidal voltage, a square wave, a pulse-modulated voltage, an amplitude-modulated voltage, a frequency-modulated voltage or other output voltage variations that produce a suitable variation in magnetic field and that result in suitable wiggling of the light source 104 (or a component thereof). U.S. Pat. No. 8,789,986 to Li, which is incorporated herein by reference, discloses examples of circuitry that can be used to move a movable flame sheet. The same or similar circuitry can be modified or otherwise adapted to provide the varying electrical voltage as part of the power controller 112.

The base 634 of the housing 632 can include a battery compartment which holds one or more batteries that store electrical power (and can serve as the power supply 110) for the flame simulator 100 and its power controller 112. The batteries can be rechargeable, or alternatively, can be disposable.

Alternatively, the base 634 of the housing 632 can include a power converter which receives AC household power via a power cord (not shown) and converts it to: (1) a DC voltage to power the light source 120 and (2) a suitable AC or varying DC voltage to power the light beam mover 108. In some embodiments, the coil 604 can be configured to generate the desired magnetic field variations using household AC power, without any switching or conversion of the AC signal (other than to provide DC power to the light source 120).

Insulated wires or other suitable electrical conductors 640 can extend from the base 634 to the light beam source 104 and can electrically connect the power supply 110 and/or power converter 112 to the light source 120 of the light beam source 104. The conductors 640 can be flexible so as to allow movement (e.g., wiggling) of the entire light beam source 104 (or one or more components thereof). If the conductors 640 are rigid and the light source 120 is fixedly mounted in the housing 600 so as to remain stationary, movement (e.g. wiggling) of the light beam 116 can be achieved by allowing other aspects of the light beam source 104 to move (e.g., wiggle). One or more of the light conditioners 122, for example, can be coupled to the extension 612 (or otherwise coupled to the light beam mover 108 or magnetic field generator 602 thereof) so that the light conditioner(s) moves (e.g., wiggles) even when the light source 120 remains stationary.

Other embodiments (e.g., the embodiments shown in FIGS. 4, 5 and 7) also can include a set of conductors 440, 540, 740 and a base 434, 534, 734 which houses the power supply 110 and/or power control 112 (including, for example, any power converters).

Figure 7:
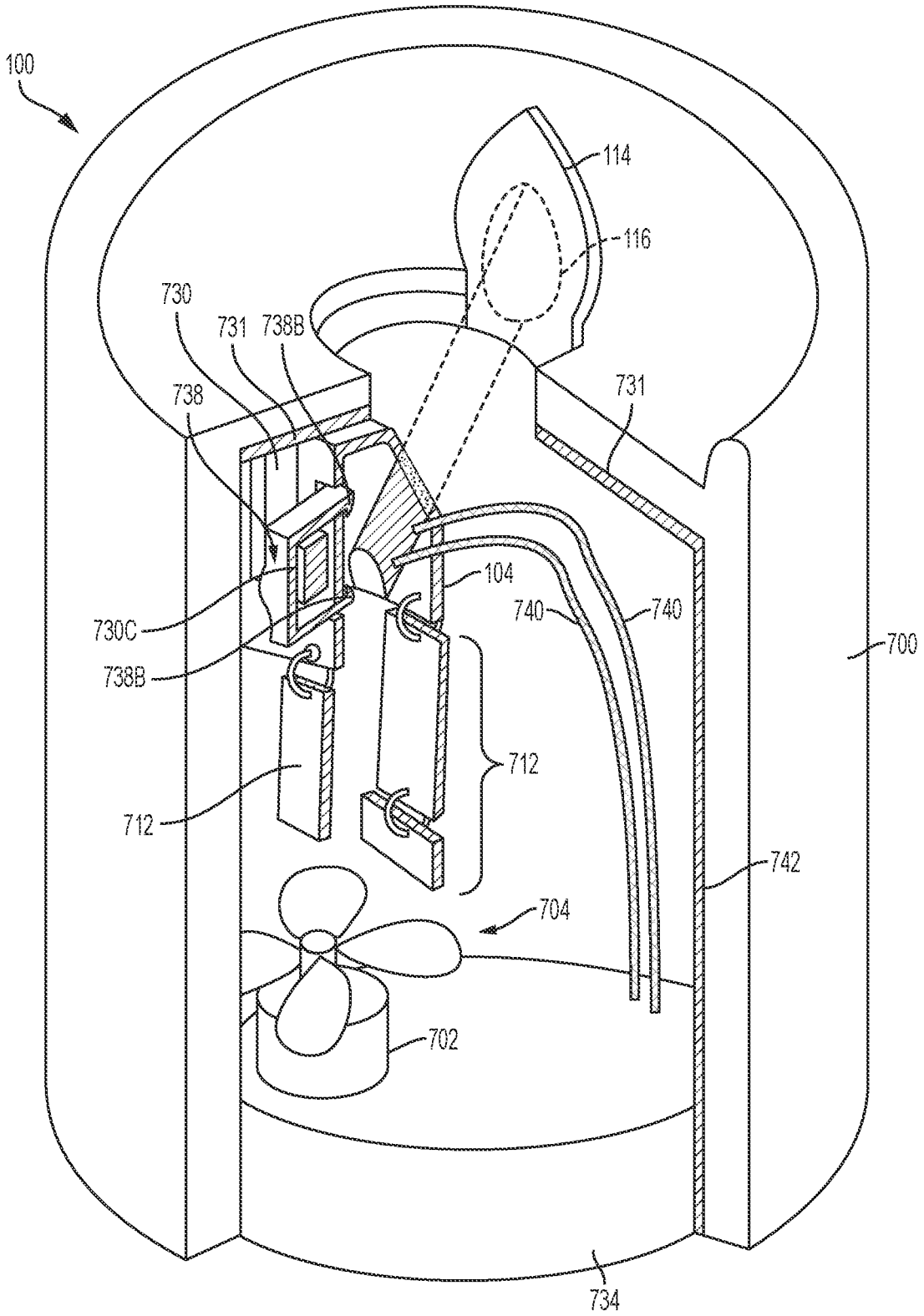
FIG. 7 is a three-quarter cross-sectional perspective view of a flame simulator according to an embodiment of the present invention.

FIG. 7 shows an embodiment of the flame simulator 100 with a housing 700 that resembles a candle. Part of the flame simulator 100 and its housing 700 have been omitted in the three-quarter cross-sectional view of FIG. 7 so that internal components of the flame simulator 100 can be seen. In the embodiment of FIG. 7, the light beam mover 108 comprises an air mover (e.g., a fan 702) adapted to generate at least one air current that impinges upon the light beam source 104 (or a component of the light beam source 104) and/or impinges on an air current-responsive element 712 that moves in response to the air current. The air current-responsive element 712 can be coupled directly or indirectly to the light beam source 104 (or part of the light beam source 104) so that movement of the air-current-responsive element 702 causes the light beam source 104 or a component thereof (e.g., the light source 120, one or more of the light conditioners 122, or both) to move (e.g., wiggle). This movement, in turn, causes the beam 116 to move (e.g., wiggle).

In the example of FIG. 7, the air current-responsive element 712 comprises several sections that are connected directly or indirectly to the light beam source 104 in an articulated manner. The air mover or fan 704 can be rotated by an electric motor 702. Power for the motor can be provided by a power source located in the base 734 of the flame simulator 100.

The extension 412, 512, 612 can be implemented as a single unit with a rigid connection to the light beam source 104, or one or more of them can be implemented as shown in the example of elements 712 in FIG. 7 as several extension sections. The extension(s) 412, 512, 612 can be implemented with an articulated connection (as in the example of elements 712 shown in FIG. 7) that allows pivoting of the extension 412, 512, 612 with respect to the light beam source 104. In some embodiments, one or more extensions 412, 512, 612 can be configured to have multiple elements that are connected to one another in an articulated manner. An example of such an arrangement is provided by elements 712 shown in FIG. 7.

The range limiter 106 of FIG. 1 can comprise an anchor 430,530, 630 or 730 as shown in FIGS. 4, 5, 6 and 7, respectively. The anchor 430, 530, 630 and 730 in the example of FIGS. 4-7 is fixed to the housing 400, 500, 600, and 700, respectively. The anchor 430, 530, 630 or 730 can be rigid or flexible. The anchor 430, 530, 630 and/or 730 can be secured to the housing 400, 500, 600, and 700, respectively, using a support ring 431, 531, 631 and/or 731, respectively. The support ring 431, 531, 631 and/or 731 can be attached to the housing 400, 500, 600 and/or 700 and/or can be part of an inner core 442, 542, 642 and/or 742 that resides in the housing 400, 500, 600 and/or 700 and that includes the base 434, 534, 634 and/or 734, respectively.

The range limiter 106 also can comprise a connector 438, 538, 638 or 738 as shown in FIGS. 4, 5, 6 and 7, respectively. The connector 438, 538, 638 and/or 738 can connect the light beam source 104 to the anchor 430, 530, 630, 730 (e.g., to a crossbar 430C, 530C, 630C or 730C of the anchor 430, 530, 630, 730), respectively, with enough play (e.g., "wiggle room") to permit the aforementioned movement (e.g., wiggling) of the light beam source 104 (or one or more components thereof). The amount and directions of play are selected to provide the aforementioned limits on movement (e.g., wiggling) of the light beam 116 in response to the light beam mover 108.

Figure 8:
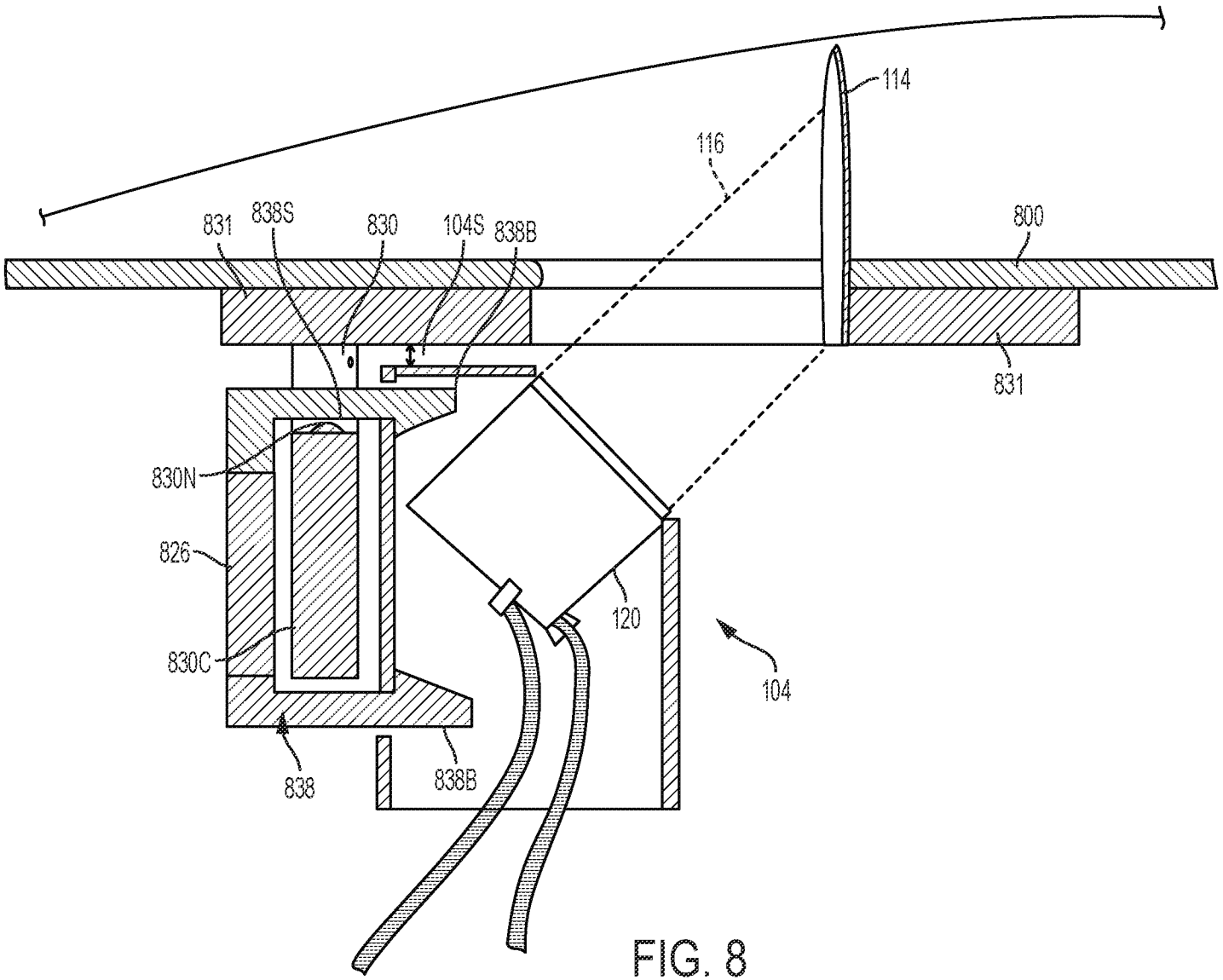
FIG. 8 is a partial cross-sectional view of a flame simulator according to an embodiment of the present invention.

FIG. 8 shows a partial cross-sectional view of an embodiment of the flame simulator 100. To facilitate the limited movement (e.g., wiggling) of the light beam 116, the crossbar 830C of the anchor 830 can be configured with an upwardly projecting nub 830N that bears against an inside surface 838S of the connector 838. Alternatively, or in addition, the inside surface 838S of the connector 838 can be provided with a downwardly project nub (not shown) to engage an upper surface of the crossbar 830C and/or the nub 830N thereof.

As shown in FIG. 8, if the coil 604 of FIG. 6 is mounted close enough to the connector 838 to expose the connector 838 to the aforementioned varying magnetic field, the connector 838 can be configured to include a magnetically responsive element 826 (e.g., a magnet). The connector 838, thereby, can serve a function similar to the extension 612 of FIG. 6 and impart movement (e.g., wiggling) to the light beam source 104 or a component thereof.

The connector 438, 538, 638, 738 and/or 838 can include one or more barbs 438B, 538B, 638B, 738B and/or 838B that resist or prevent removal of the connector 438, 538, 638, 738 and/or 838 from the light beam source 104 after the connector 438, 538, 638, 738 and/or 838 has been snap-fit across the crossbar 430C, 530C, 630*c*, 730C and/or 830C and into light beam source 104. The barbs 438B, 538B, 638B, 738B and/or 838B can be flexible or rigid.

The connector 438, 538, 638, 738 and/or 838 and anchor 430, 530, 630, 730, 830 of the range limiter 106 are configured (shape, size, placement, and arrangement) to limit movement of the light beam source 104 (or movement of the light source 120 or light conditioners 122 thereof) and the movable beam 116 so that the beam 116 of light, when projected, strikes at least a portion of the flame screen 114 and causes illumination of the flame screen 114 by the beam 116 to resemble a flame. The light beam mover 108, the connector 438, 538, 638, 738 and/or 838 and the anchor 430, 530, 630, 730, 830 can be configured so that movement (e.g., wiggling) of the movable beam 116 in response to the light beam mover 108 causes changes in the shape and position of the illumination of the flame screen 114 by the beam 116. Such changes in the illumination of the flame screen 114 can be made to mimic movement of a flame exposed to ambient air currents. The light beam mover 108 can generate the beam movement and the connector 438, 538, 638, 738 and/or 838 and anchor 430, 530, 630, 730, 830 can limit the range of movement so that the beam 116 stays mostly on the flame screen 114 in a region bounded by the typical range of movement of the flame being simulated (e.g., a candle flame moving in response to ambient air currents). The light beam mover 108 can cause the illumination provided by the beam 116 to dance on the flame screen 114 with variations in position and shape that mimic a dancing flame (e.g., a candle flame being blown about by air currents).

Figure 9:
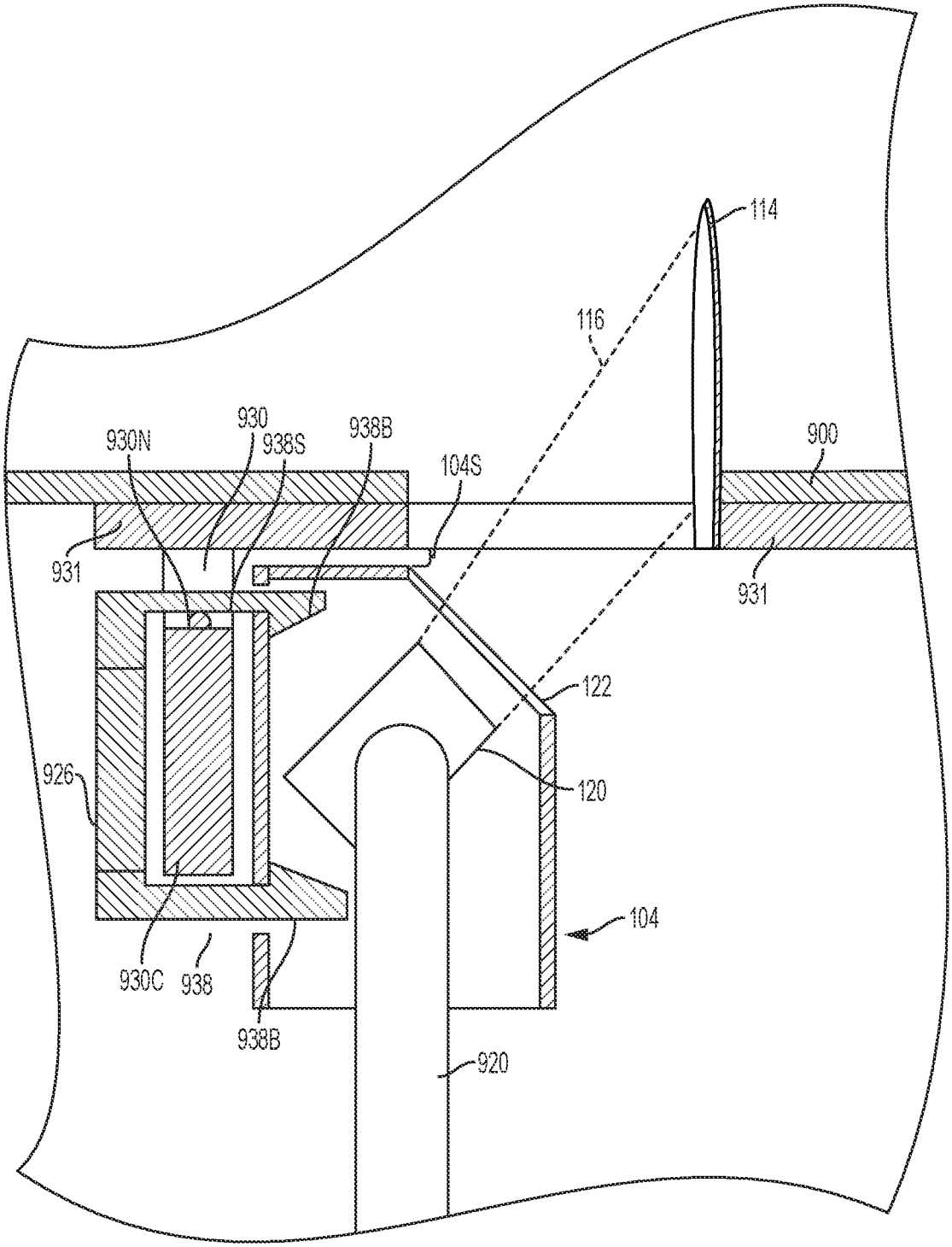
FIG. 9 is a partial cross-sectional view of a flame simulator according to an embodiment of the present invention.

FIG. 9 shows a partial cross-sectional view of an embodiment of the flame simulator 100 which is configured to allow the light source 120 to remain stationary while other aspects of the light beam source 104 (e.g., one or more light conditioners 122) move (e.g., wiggle) in response to the light beam mover 108. The light source 120 can be mounted to a stationary support 920. The stationary support 920 can be connected to the housing (e.g., housings 400, 500, 600, or 700) directly or indirectly. Examples of indirect connection can include a connection of the stationary support 920 to a base (e.g., base 434, 534, 634, or 734 of FIGS. 4, 5, 6 and 7, respectively) or to an inner core (e.g., inner core 442, 542, 642, or 742 of FIGS. 4, 5, 6 and 7, respectively).

To facilitate the limited movement (e.g., wiggling) of the light beam 116, the crossbar 930C of the anchor 930 can be configured with an upwardly projecting nub 930N that bears against an inside surface 938S of the connector 938. Alternatively, or in addition, the inside surface 938S of the connector 938 can be provided with a downwardly project nub (not shown) to engage an upper surface of the crossbar 930C and/or the nub 930N thereof.

As shown in FIG. 9, if the coil 604 of FIG. 6 is mounted close enough to the connector 938 to expose the connector 938 to the aforementioned varying magnetic field, the connector 938 can be configured to include a magnetically responsive element 926 (e.g., a magnet). The connector 938, thereby, can serve a function similar to the extension 612 of FIG. 6 and impart movement (e.g., wiggling) to aspects of the light beam source 104 other than the light source 120.

The connector 938 can include one or more barbs 938B that resist or prevent removal of the connector 938 from the light beam source 104 after the connector 938 has been snap-fit across the crossbar 930C and into light beam source 104. The barbs 938B can be flexible or rigid.

The connector 938 and anchor 930 of the range limiter 106 are configured (shape, size, placement, and arrangement) to limit movement (e.g., wiggling) of the light beam source 104 and the movable beam 116 so that the beam 116 of light, when projected, strikes at least a portion of the flame screen 114 and causes illumination of the flame screen 114 by the beam 116 to resemble a flame. The light beam mover 108, the connector 938 and the anchor 930 can be configured so that movement (e.g., wiggling) of the movable beam 116 in response to the light beam mover 108 causes changes in the shape and position of the illumination of the flame screen 114 by the beam 116. Such changes in the illumination of the flame screen 114 can be made to mimic movement of a flame exposed to ambient air currents. The light beam mover 108 can generate the beam movement and the connector 938 and anchor 930 can limit the range of movement so that the beam 116 stays mostly on the flame screen 114 in a region bounded by the typical range of movement of the flame being simulated (e.g., a candle flame moving in response to ambient air currents). The light beam mover 108 can cause the illumination provided by the beam 116 to dance on the flame screen 114 with variations in position and shape that mimic a dancing flame (e.g., a candle flame being blown about by air currents).

Figure 10:
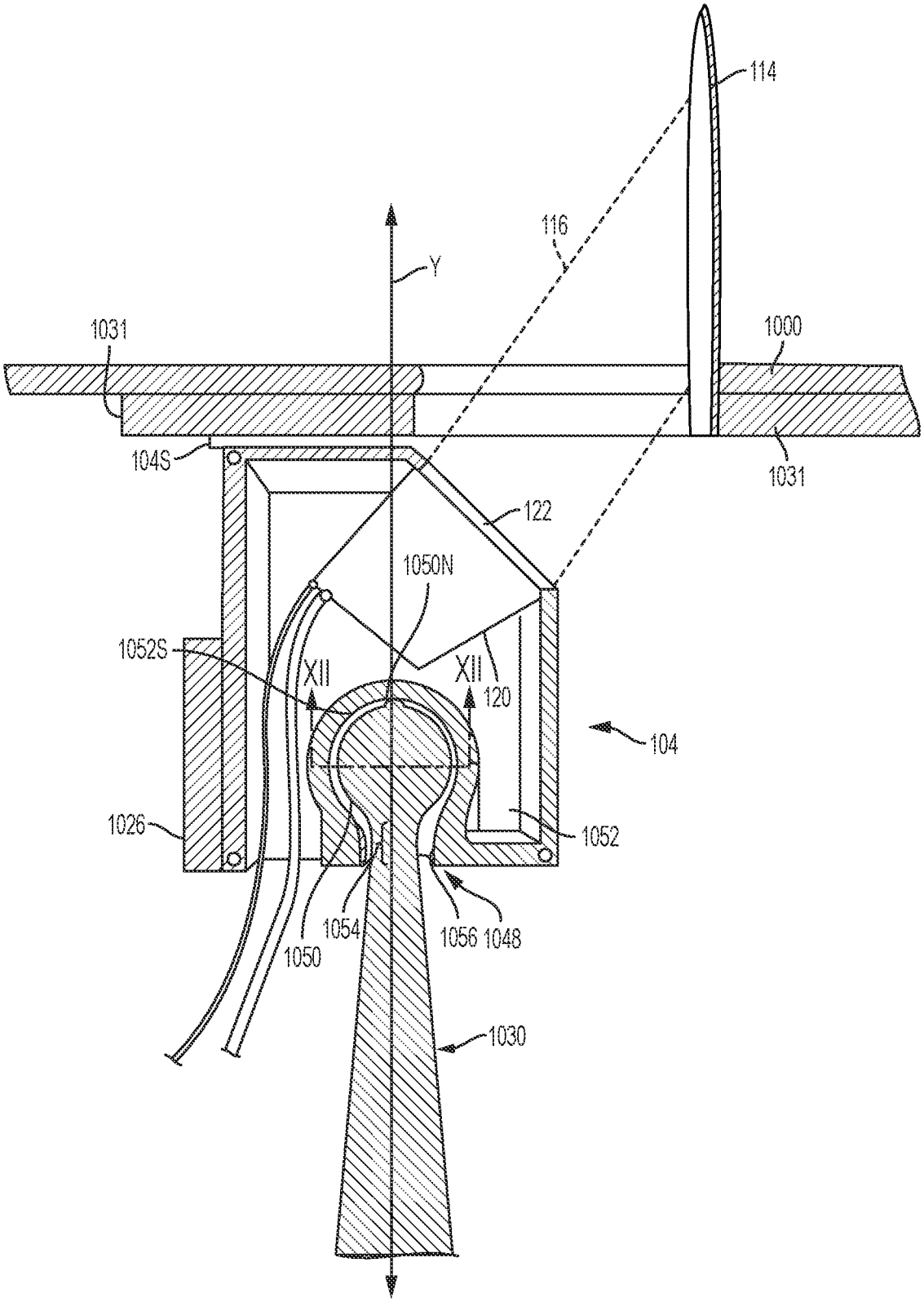
FIG. 10 is a partial cross-sectional view of a flame simulator according to an embodiment of the present invention.

FIG. 10 is a partial cross-sectional view of an embodiment of the flame simulator 100 that comprises a ball-and-socket coupling 1048 between the light beam source 104 and an anchor 1030. The ball-and-socket coupling 1048 constitutes at least part of the range limiter 106. The portion of the anchor 1030 which is not shown in FIG. 10 can be connected to the housing 1000 (e.g., housing 400, 500, 600, or 700) directly or indirectly. Examples of indirect connection can include a connection of the anchor 1030 to a base (e.g., base 434, 534, 634, or 734 of FIGS. 4, 5, 6 and 7, respectively) or to an inner core (e.g., inner core 442, 542, 642, or 742 of FIGS. 4, 5, 6 and 7, respectively).

Figure 11:
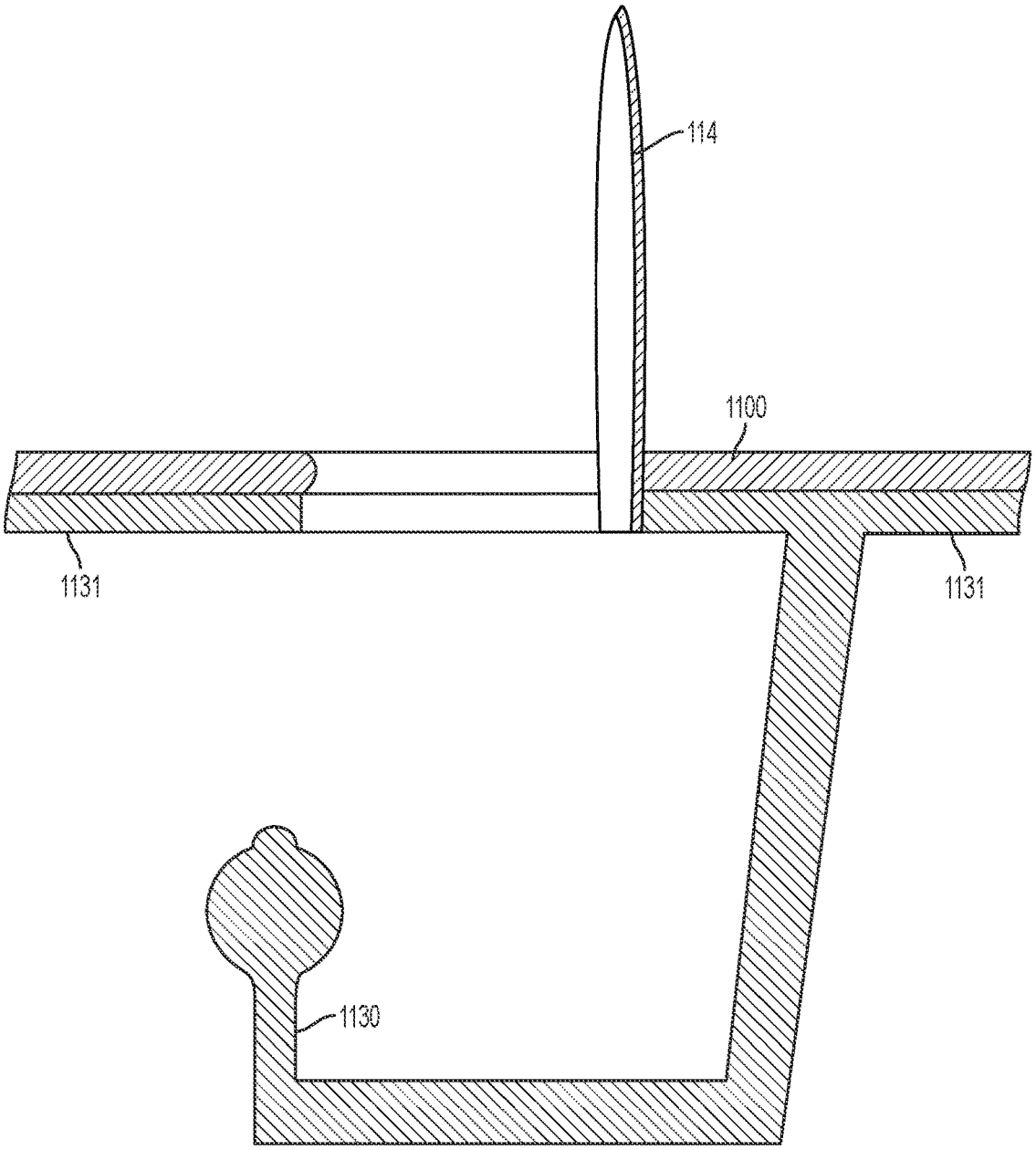
FIG. 11 is a cross-sectional view of an embodiment of an anchor according to an embodiment of the present invention.

FIG. 11 is a cross-sectional view of an embodiment of the anchor 1130 that connects to the housing 1100 (e.g., housing 400, 500, 600, 700 or 1000) by way of a connection to a support ring 1131 (e.g., support ring 431, 531, 631 and/or 731 of FIGS. 4, 5, 6 and 7, respectively).

With reference to the embodiment shown in FIG. 10, the ball-and-socket coupling 1048 comprises a ball 1050 associated with the anchor 1030 and a socket 1052 associated with the light beam source 104. The ball-and-socket coupling 1048 is configured with enough play (e.g., "wiggle room") between the ball 1050 and the socket 1052 to permit the aforementioned movement (e.g., wiggling) of the light beam source 104 (or one or more components thereof). The amount and directions of play are selected to provide the aforementioned limits on movement (e.g., wiggling) of the light beam 116 in response to the light beam mover 108.

Figure 12:
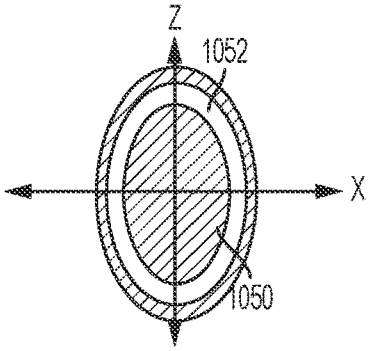
FIG. 12 is a cross-sectional view of a ball-and-socket coupling taken along line XII-XII of FIG. 10.

FIG. 12 is a cross-sectional view of the ball-and-socket coupling 1048 taken along line XII-XII of FIG. 10. According to the embodiment shown in FIG. 12, the ball 1050 and the socket 1052 are wider along a horizontal Z axis than along a horizontal X axis. These differences in widths and the aforementioned play are selected so that the angle of rotation of the socket 1052 about a vertical axis Y remains within a predetermined angle less than 45 degrees. The predetermined angle can be selected so that the beam 116 (when projected) does not stray completely off of the flame screen 114, or alternatively, so that the beam 116 remains completely within the lateral edges of the flame screen 114 (or within some other range that coincides with the lateral range across which a candle flame might dance). The configuration of the ball-and-socket coupling 1048, in this manner, can limit the beam's lateral range of movement and can serve as part of the range limiter 106.

With reference to FIG. 10, the ball-and-socket coupling 1048 includes a neck 1054 between the ball 1050 and the anchor 1030. The neck 1054 is configured to interfere mechanically with a rim 1056 of the socket 1052. This mechanical interference imposes a limit on the vertical tilt of the beam 116. By suitably configuring the shape and size of the neck 1054 and rim 1056, the tilt limit can be selected so that the beam 116 (when projected) does not stray completely off of the flame screen 114 vertically, or alternatively, so that the beam 116 remains completely within the top and bottom edges of the flame screen 114 (or within some other range that coincides with the vertical range across which a candle flame might dance). The configuration of the ball-and-socket coupling 1048 thereby can limit the beam's vertical range of movement and can serve as part of the range limiter 106.

To facilitate the limited movement (e.g., wiggling) of the light beam 116 and reduce friction in the ball-and-socket coupling 1048, the ball 1050 can be configured with an upwardly projecting nub 1050N that bears against an inside surface 1052S of the socket 1050. Alternatively, or in addition, the inside surface 1052S of the socket 1052 can be provided with a downwardly project nub (not shown) to engage an upper surface of the ball 1050.

Although FIG. 10 shows an embodiment wherein the ball 1050 is associated with the anchor 1030 and the socket 1052 is associated with the light beam source 104, an alternative embodiment can be implemented wherein the ball is associated with the light beam source 104 and the socket is associated with the anchor.

As shown in FIG. 10, if the coil 604 of FIG. 6 is mounted close enough to the light beam source 104 to expose the light beam source 104 to the aforementioned varying magnetic field, the light beam source 104 can be configured to include a magnetically responsive element 1026 (e.g., a magnet). The magnetically responsive element 1026, thereby, can impart movement (e.g., wiggling) to the light beam source 104 or a component thereof.

The ball 1050 and socket 1052 of the range limiter 106 are configured (shape, size, placement, and arrangement) to limit movement of the light beam source 104 (or movement of the light source 120 or light conditioners 122 thereof) and the movable beam 116 so that the beam 116 of light, when projected, strikes at least a portion of the flame screen 114 and causes illumination of the flame screen 114 by the beam 116 to resemble a flame. The light beam mover 108, the ball 1050, and socket 1052 can be configured so that movement (e.g., wiggling) of the movable beam 116 in response to the light beam mover 108 causes changes in the shape and position of the illumination of the flame screen 114 by the beam 116. Such changes in the illumination of the flame screen 114 can be made to mimic movement of a flame exposed to ambient air currents. The light beam mover 108 can generate the beam movement and the ball-and-socket coupling 1048 can limit the range of movement so that the beam 116 stays mostly on the flame screen 114 in a region bounded by the typical range of movement of the flame being simulated (e.g., a candle flame moving in response to ambient air currents). The light beam mover 108 can cause the illumination provided by the beam 116 to dance on the flame screen 114 with variations in position and shape that mimic a dancing flame (e.g., a candle flame being blown about by air currents).

Figure 13:
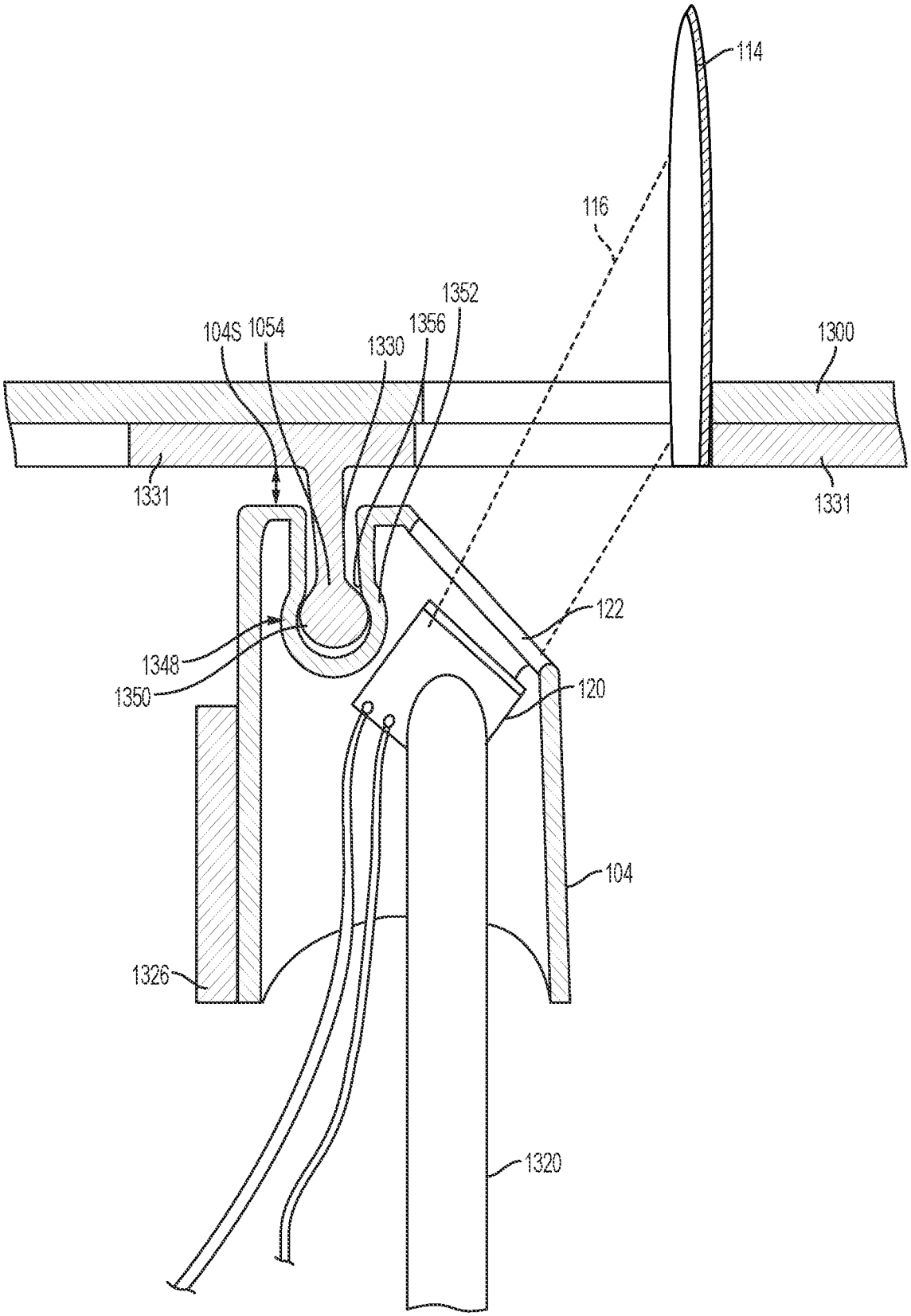
FIG. 13 is a partial cross-sectional view of a flame simulator according to an embodiment of the present invention.

FIG. 13 shows a partial cross-sectional view of an embodiment of the flame simulator 100 which is configured to allow the light source 120 to remain stationary while other aspects of the light beam source 104 (e.g., one or more light conditioners 122) move (e.g., wiggle) in response to the light beam mover 108. The light source 120 can be mounted to a stationary support 1320. The stationary support 1320 can be connected to the housing (e.g., housing 400, 500, 600 or 700) directly or indirectly. Examples of indirect connection to the housing include connection of the stationary support 1320 to a base (e.g., base 434, 534, 634, or 734 of FIGS. 4, 5, 6 and 7, respectively) or to an inner core (e.g., inner core 442, 542, 642, or 742 of FIGS. 4, 5, 6 and 7, respectively). The stationary support 1320, alternatively or in addition, can be connected to the housing 1300 (e.g., housing 400, 500, 600, 700, 1000 or 1100) by way of a connection to a support ring 1331 (e.g., support ring 431, 531, 631, 731, 1031, 1131 of FIG. 4, 5, 6, 7, 10 or 11 respectively).

The embodiment of the flame simulator shown in FIG. 13 can comprise a ball-and-socket coupling 1048 between the light beam source 104 and an anchor 1030. The ball-and-socket coupling 1348 constitutes at least part of the range limiter 106. The anchor 1330 can be connected to the housing 1300 (e.g., housing 400, 500, 600, or 700) directly or indirectly. Examples of indirect connection can include a connection of the anchor 1330 to a base (e.g., base 434, 534, 634, or 734 of FIGS. 4, 5, 6 and 7, respectively), to an inner core (e.g., inner core 442, 542, 642, or 742 of FIGS. 4, 5, 6 and 7, respectively), or as shown in FIG. 13, by way of a connection to a support ring 1331 (e.g., support rings 431, 531, 631 and/or 731 of FIGS. 4, 5, 6 and 7, respectively).

The ball-and-socket coupling 1348 can comprise a ball 1350 associated with the anchor 1330 and a socket 1352 associated with the light beam source 104. The ball-and-socket coupling 1348 is configured with enough play (e.g., "wiggle room") between the ball 1350 and the socket 1352 to permit the aforementioned movement (e.g., wiggling) of the light beam source 104 (or one or more components thereof). The amount and directions of play are selected to provide the aforementioned limits on movement (e.g., wiggling) of the light beam 116 in response to the light beam mover 108.

The ball-and-socket coupling 1350 can be implemented using the configuration illustrated in FIG. 12, wherein the ball 1050 and the socket 1052 are wider along a horizontal Z axis than along a horizontal X axis. These differences in widths and the aforementioned play can be selected so that the angle of rotation of the socket 1352 about a vertical axis Y remains within a predetermined angle less than 45 degrees. The predetermined angle can be selected so that the beam 116 (when projected) does not stray completely off of the flame screen 114, or alternatively, so that the beam 116 remains completely within the lateral edges of the flame screen 114 (or within some other range that coincides with the lateral range across which a candle flame might dance). The configuration of the ball-and-socket coupling 1348, in this manner, can limit the beam's lateral range of movement and can serve as part of the range limiter 106.

The ball-and-socket coupling 1348 can include a neck 1354 between the ball 1350 and the anchor 1330. The neck 1354 is configured to interfere mechanically with a rim 1356 of the socket 1352. This mechanical interference imposes a limit on the vertical tilt of the beam 116. By suitably configuring the shape and size of the neck 1354 and rim 1356, the tilt limit can be selected so that the beam 116 (when projected) does not stray completely off of the flame screen 114 vertically, or alternatively, so that the beam 116 remains completely within the top and bottom edges of the flame screen 114 (or within some other range that coincides with the vertical range across which a candle flame might dance). The configuration of the ball-and-socket coupling 1348 thereby can limit the beam's vertical range of movement and can serve as part of the range limiter 106.

Although FIG. 13 shows an embodiment wherein the ball 1350 is associated with the anchor 1330 and the socket 1352 is associated with the light beam source 104, an alternative embodiment can be implemented wherein the ball is associated with the light beam source 104 and the socket is associated with the anchor.

As shown in FIG. 13, if the coil 604 of FIG. 6 is mounted close enough to the light beam source 104 to expose the light beam source 104 to the aforementioned varying magnetic field, the light beam source 104 can be configured to include a magnetically responsive element 1326 (e.g., a magnet). The magnetically responsive element 1326, thereby, can impart movement (e.g., wiggling) to the light beam source 104 or a component thereof.

The ball 1350 and socket 1352 of the range limiter 106 are configured (shape, size, placement, and arrangement) to limit movement of the light beam source 104 (or light conditioners 122 thereof) and the movable beam 116 so that the beam 116 of light, when projected, strikes at least a portion of the flame screen 114 and causes illumination of the flame screen 114 by the beam 116 to resemble a flame. The light beam mover 108, the ball 1350, and socket 1352 can be configured so that movement (e.g., wiggling) of the movable beam 116 in response to the light beam mover 108 causes changes in the shape and position of the illumination of the flame screen 114 by the beam 116. Such changes in the illumination of the flame screen 114 can be made to mimic movement of a flame exposed to ambient air currents. The light beam mover 108 can generate the beam movement and the ball-and-socket coupling 1048 can limit the range of movement so that the beam 116 stays mostly on the flame screen 114 in a region bounded by the typical range of movement of the flame being simulated (e.g., a candle flame moving in response to ambient air currents). The light beam mover 108 can cause the illumination provided by the beam 116 to dance on the flame screen 114 with variations in position and shape that mimic a dancing flame (e.g., a candle flame being blown about by air currents).

Figure 14:
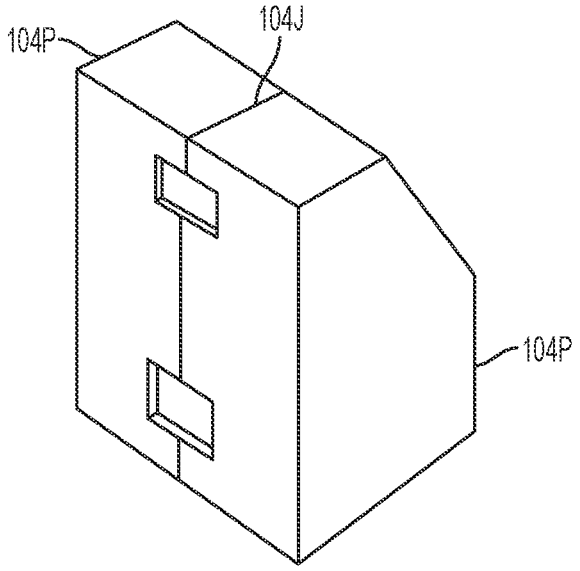
FIG. 14 is a perspective view of two shell pieces of light beam source of a flame simulator according to an embodiment of the present invention.

FIG. 14 shows two shell pieces 104P that can be joined together at a junction 104J to provide a shell which houses and/or supports the light source 120 of the light beam source 104. The arrangement of FIG. 14 facilitates assembly of the light beam source 104. During assembly, the light source 120 and any light conditioners 122 can be mounted in one of the shell pieces 104P so as to be retained in position and, if a ball-and-socket coupling is utilized, the ball (e.g., ball 1050 or 1350) can be inserted in the part of the socket (e.g., socket 1052 or 1352) that is formed in a shell piece 104P. The two shell pieces 104P then can be joined to form a shell that supports and/or houses the light beam source 104.

Figure 15:
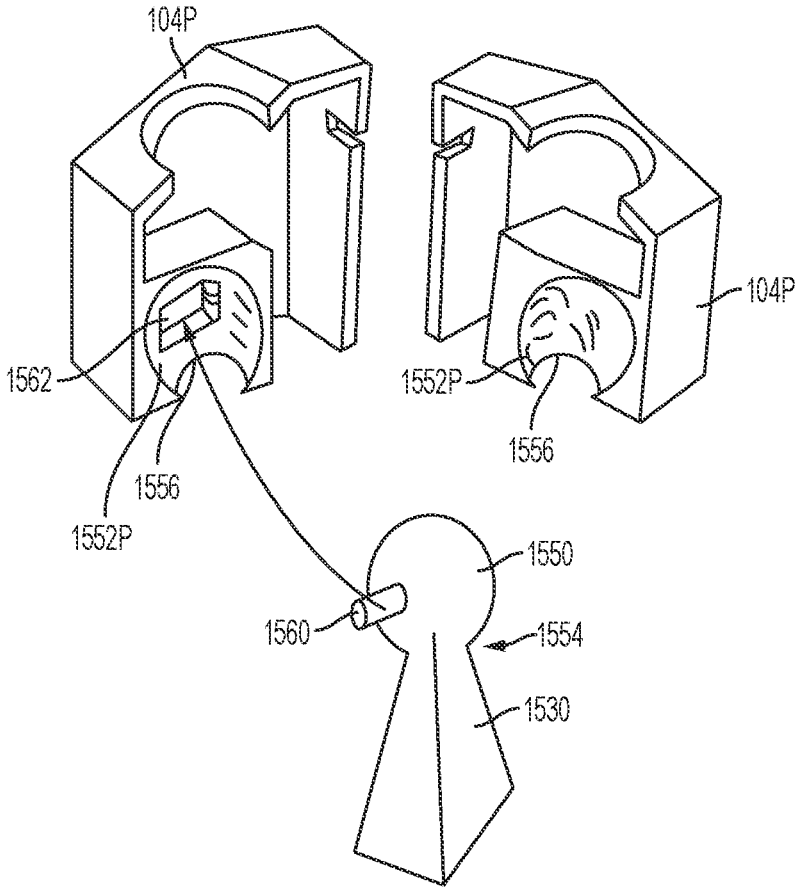
FIG. 15 is an exploded view of two shell pieces and an anchor that are combinable to form a ball-and-socket coupling for a flame simulator according to an embodiment of the present invention.

FIG. 15 shows another embodiment of the shell pieces 104P before assembly of the light beam source 104. The shell pieces 104P in FIG. 15 are configured to facilitate use of a ball-and-socket coupling. The ball-and-socket coupling includes a ball 1550 and a socket that is defined by two socket portions 1552P. The mechanical interference that forms part of the range limiter 106 can be achieved by suitably configuring a neck 1554 between the ball 1550 and the anchor 1530. The neck 1554 is configured to interfere mechanically with a rim 1556 of the socket portions 1552P. This mechanical interference imposes a limit on the vertical tilt of the beam 116. By suitably configuring the shape and size of the neck 1554 and rim 1556, the tilt limit can be selected so that the beam 116 (when projected) does not stray completely off of the flame screen 114 vertically, or alternatively, so that the beam 116 remains completely within the top and bottom edges of the flame screen 114 (or within some other range that coincides with the vertical range across which a candle flame might dance). The configuration of the ball-and-socket coupling thereby can limit the beam's vertical range of movement and can serve as part of the range limiter 106.

An additional (or alternative) aspect of the range limiter 106 can be implemented by providing a protrusion 1560 on the ball 1550 and hole 1562 in at least one of the socket portions 1552P. During assembly of the light beam source 104, the protrusion 1560 can be inserted in the hole 1562. After assembly, the protrusion 1560 can mechanically interfere with the walls of the hole 1562. This mechanical interference imposes limits on the beam's 116 range of movement. By suitably configuring the shape and size of the protrusion 1560 and hole 1562, the range limit can be selected so that the beam 116 (when projected) does not stray completely off of the flame screen 114, or alternatively, so that the beam 116 remains completely on the flame screen 114 (or within some other range that coincides with the range across which a candle flame might dance). The configuration of the protrusion 1560 and hole 1562 thereby can limit the beam's range of movement and can serve as part of the range limiter 106. Although FIG. 15 shows the protrusion 1560 on the ball 1550 and the hole 1562 on at least one of the socket portions 1552P, other mechanisms of providing mechanical interference can be used. For example, the protrusion can be located in at least one of the socket portions 1552P, and the hole can be located in the ball 1550.

The invention is not limited to the foregoing embodiments of the range limiter 106. To the contrary, other embodiments of range limiters 106 can be utilized based on other techniques for providing a suitable form on mechanical interference or otherwise limiting the range of beam movement.

Any of the housings (e.g., housing 300, 400, 500, 600, 700, 800, 900, 1000, 1100 and/or 1300) can be made of a material that is translucent and/or constitutes or resembles wax. In addition, the light source 120 can be configured to direct some light toward an upper portion of the housing (e.g., housing 300, 400, 500, 600, 700, 800, 900, 1000, 1100 and/or 1300) so that the upper portion of the housing glows in a manner that resembles a real candle glowing as a result of light from its flame. The flame screen 114 also can be configured with translucent properties that allow some of light from the beam 116 to pass through the flame screen and provide a glow to the candle housing and/or other objects behind the candle screen. The translucent properties can be selected so that this glow resembles the glow that a real candle's flame would provide.

The aforementioned glow of the housing (e.g., housing 300, 400, 500, 600, 700, 800, 900, 1000, 1100 and/or 1300) can be facilitated by using translucent and/or transparent materials in the construction of the light beam source 104 and/or by providing one or more light conditioners 122 that reflect, spread and/or diffuse some of the light from the light source 120 in addition to providing the light beam 116 with a round cross-sectional shape and the aforementioned quality, intensity, and color of light. Alternatively, or in addition, the aforementioned glow of the housing (e.g., housing 300, 400, 500, 600, 700, 800, 900, 1000, 1100 and/or 1300) can be facilitated by providing one or more additional sources of light (in addition to the light source 120) in the housing and directing light from those additional sources toward an upper portion of the housing (e.g., housing 300, 400, 500, 600, 700, 800, 900, 1000, 1100 and/or 1300).

The range limiter 106 also can include mechanical interference between: (1) a top (or other feature) of the light beam source 104 and (2) a ceiling inside the housing (e.g., housing 300, 400, 500, 600, 700, 800, 900, 1000, 1100 and/or 1300) and/or a support ring (e.g., support ring 431, 531, 631, 731, 1131 or 1331 of FIG. 4, 5, 6, 7, 11 or 13 respectively). This mechanical interference can be achieved by suitably configuring the size and shape of the aforementioned components and selecting the space 104S between: (1) the top (or other feature) of the light beam source 104 and (2) the ceiling inside the housing (e.g., housing 300, 400, 500, 600, 700, 800, 900, 1000, 1100 and/or 1300) and/or the support ring (e.g., support ring 431, 531, 631, 731, 1131 or 1331 of FIG. 4, 5, 6, 7, 11 or 13 respectively) so that the tilt of the light beam 116 stays within a range that keeps the light beam 116 at least partially on the flame screen 114, or completely on the flame screen 114, and/or so that the illumination of the flame screen 114 by the beam 116 mimics a dancing candle flame.

Figure 16:
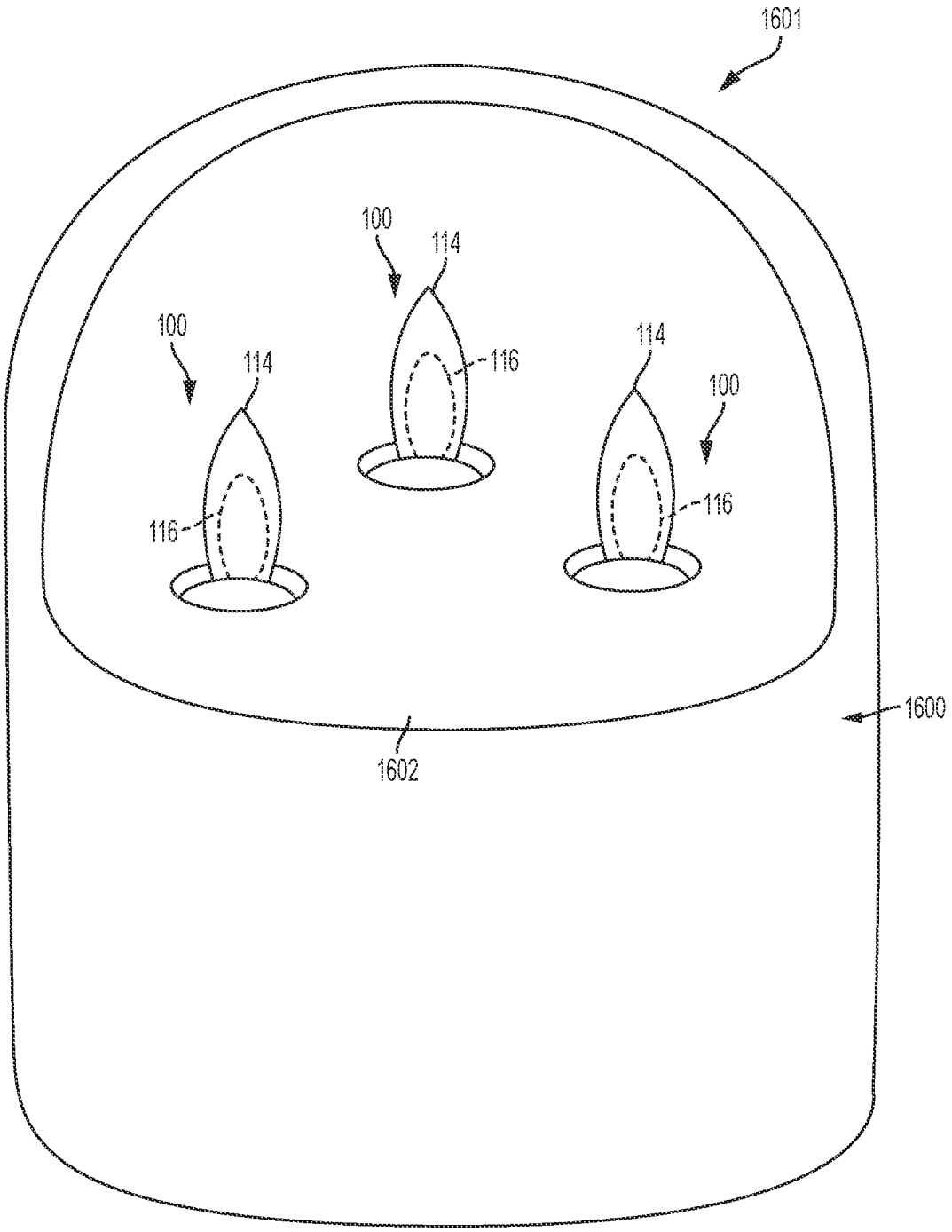
FIG. 16 is a perspective view of an imitation candle according to an embodiment of the present invention.

FIG. 16 shows an embodiment of an imitation candle 1601 that includes multiple flame simulators 100 and multiple light beams 116 adapted to simulate burning of a multi-wick candle. The embodiment of FIG. 16 comprises three flame simulators 100, but any other number of flame simulators 100 can be utilized to mimic any number of burning wicks.

The embodiment of FIG. 16 comprises a candle body/housing 1600. The candle body/housing 1600 comprises an upper surface 1602. Each flame simulator 100 includes a flame screen 114 located at the upper surface 1702 and extending upwardly from the upper surface 1702. The flame screens 114 are laterally spaced apart from each other to simulate a candle having multiple burning wicks.

Inside the candle body/housing 1600, each light beam mover 108 (examples of which are shown in the previous drawings) and each range limiter 106 (examples of which are shown in the previous drawings) of the flame simulators 100 are configured so that movement of each movable beam 116 of light in response to a corresponding one of the light beam movers 108 causes changes in a corresponding illumination of a corresponding one of the flame screens 114 and so that those changes mimic movement of a flame exposed to ambient air currents. Each light beam mover 108 and each range limiter 106 are configured so that movement of each movable beam 116 of light in response to a corresponding one of the light beam movers 108 causes changes in shape and position of the corresponding illumination of the corresponding flame screen 114 by the corresponding beam 116 of light.

Each light beam source 104 (examples of which are shown in the previous drawings) is adapted to produce a yellowish beam of light with a shape, intensity and color that result in a candle flame-mimicking illumination of a corresponding flame screen 114.

Figure 17:
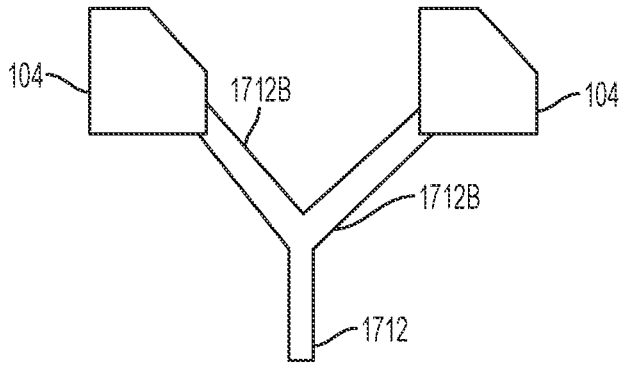
FIG. 17 is a schematic view of multiple light beam sources connected to a multi-branch extension of at least one flame simulator according to an embodiment of the present invention.

Each flame simulator 100 in FIG. 16 can be implemented using any one or more of the structures and techniques shown in the previous drawings and described above. Alternatively (or in addition) different structures and techniques can be used. In some embodiments, the flame simulators 100 can share componentry and/or power. For example, a power supply 110 can be configured to supply power to one or more of the flame simulators 100 via one shared power controller 112 or multiple power controllers 112. In addition, one or more light beam movers 108 (examples of which are shown in the previous drawings and described above) can be coupled to multiple ones (or all) of the light beam sources 104 to effect the aforementioned movement of the beam 116 without having to replicate all of the components of the light beam mover 108. For example, as shown in FIG. 17, an extension 1712 can comprise multiple branches 1712B to couple multiple light beam sources 104 so that they share components of the light beam mover 108 (examples of which include the motor and actuator-based embodiment of FIG. 4; the motor and magnetic coupling-based embodiment of FIG. 5; the magnetic coupling-based embodiment of FIG. 6; and the air-mover-based embodiment of FIG. 7).

In some examples, it is also possible to implement the flame simulators 100 independently of one another so that each flame simulator 100 has its own light beam mover 108, range limiter 106, power controller 112 and power supply 110.

Figure 18:
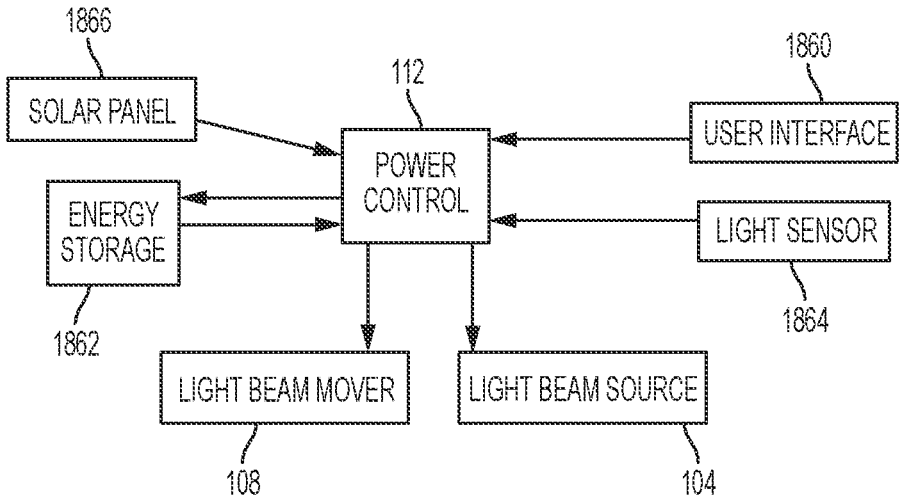
FIG. 18 is a block diagram of a flame simulator according to an embodiment of the present invention.

FIG. 18 shows an embodiment of the flame simulator 100 that includes a user interface 1860 (e.g., one or more switches and/or one or more indicators of selectable operating modes). The user interface 1860 is connected directly or indirectly to the power controller 112. Via the user interface 1860, a user of the flame simulator 100 can control operation of the flame simulator 100. The user interface 1860 and power controller 112 can be configured to allow the user to turn the flame simulator 100 on and/or off, to select a setting whereby the flame simulator 100 is activated and/or deactivated on a timed basis (e.g., active or inactive for a predetermined period of time or for one of several user-selectable periods of time), to select a setting whereby the flame simulator 100 turns on automatically in response to one or more predetermined conditions (e.g., time of day, detection of motion and/or low ambient light conditions), and/or to select a setting whereby the flame simulator 100 turns off in response to one or more other predetermined conditions (e.g., time of day, absence of motion for a predetermined period of time and/or high ambient light conditions). The power controller 112 can be connected directly or indirectly to the user interface 1860, can be configured to determine which one or more settings are selected by the user, and can be configured to control the flame simulator 100 accordingly. The aforementioned functionality can be achieved using suitable circuitry and/or a processor that is programmed to execute, or is programmed to read software from a memory unit that causes the processor to execute, the mode of operation selected by the user.

The embodiment of FIG. 18 can include a light beam source 104 (e.g., any one or more of the light beam sources 104 shown in the previous drawings and disclosed in the above description, or other configurations of light beam sources 104), a light beam mover 108 (e.g., any one or more of the light beam movers 108 shown in the previous drawings and disclosed in the above description, or other configurations of light beam movers 108), a range limiter 106 (e.g., any one or more of the range limiters 106 shown in the previous drawings and disclosed in the above description, or other configurations of range limiters 106), an energy storage element 1862 (e.g., one or more rechargeable batteries), a light sensor 1864, and/or a solar panel 1866 adapted to convert light energy into electrical energy. In some embodiments, use of a distinct light sensor 1864 can be avoided by using the solar panel 1866 to indicate to the power controller the intensity (if any) of ambient light impinging on the solar panel 1866.

The user interface 1860 can provide one or more inputs to the power controller 112, each input being indicative of a user-selected mode of operation. The light sensor 1864 can be configured to detect light and provide an input to the power controller 112 indicating whether the light sensor 1864 is exposed to light and/or how much light is impinging on the light sensor 1864. The input from the light sensor 1864 allows the power controller 112 to determine, based on the ambient light conditions and/or the user-selected operating mode, whether to turn on and/or off the flame simulator 100. In addition, or alternatively, the input from the light sensor 1864 can be used by the power controller 112 to determine whether to charge the energy storage element 1862 using power from the solar panel 1866.

The energy storage element 1862 and the power controller 112 can be interconnected and configured so that the power controller 112 can be powered by the energy storage element 1862, so that the power controller 112 can charge the energy storage element 1862 using power from the solar panel 1866, and/or so that the power controller 112 can be powered at least partially by the solar panel (e.g., when the energy storage element 1862 lacks enough power to operate the flame simulator 100 but the solar panel is exposed to light).

The power controller 112 of FIG. 18 also has at least one output that supplies power to the light beam mover 108 and the light beam source 104, when the power controller 112 determines, based its various inputs that the flame simulator 100 is to be activated.

Figure 19:
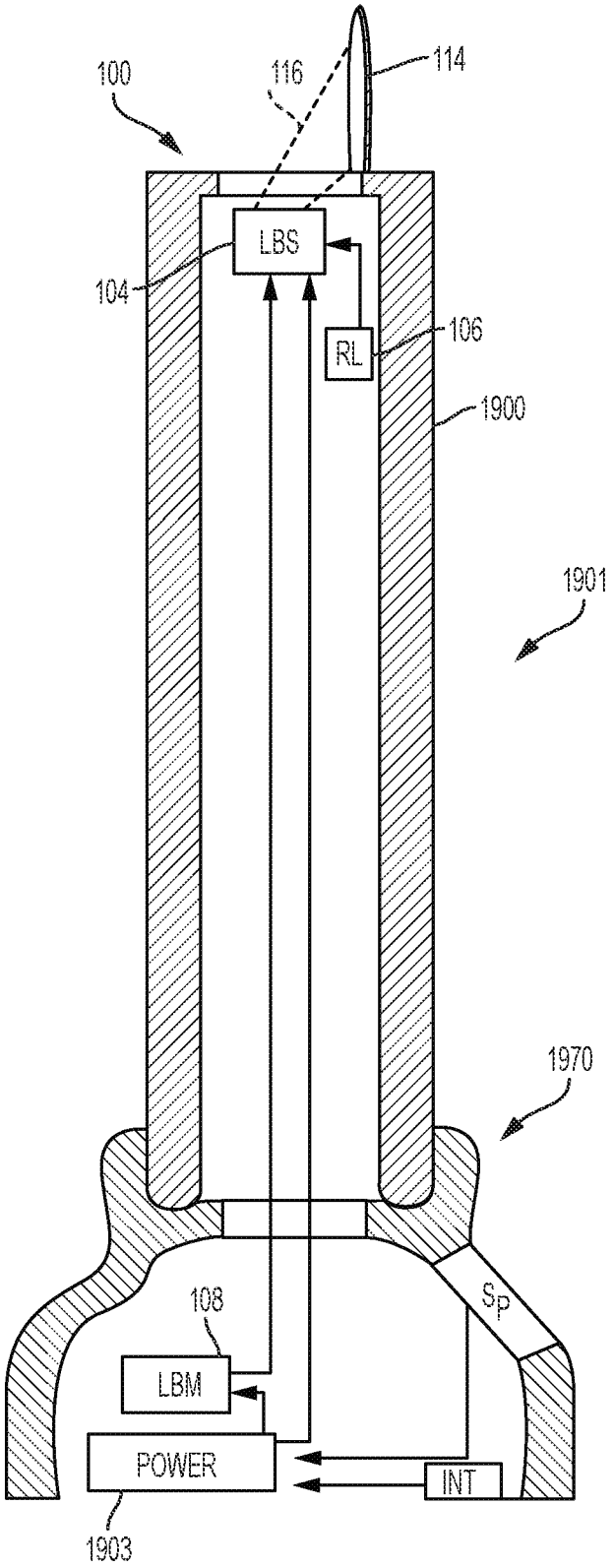
FIG. 19 is a block diagram of an imitation candle according to an embodiment of the present invention.

FIG. 19 is a cross-sectional, semi-schematic view of an imitation candle 1901. The imitation candle 1901 comprises a candle body/housing 1900 that resembles a wax candle and a candle holder 1970 adapted to support the candle body 1900. The imitation candle 1901 also comprises at least one flame simulator 100 and a power supply circuit 1903. The power supply circuit 1903 can include the energy storage element 1862 and/or the power controller 112 of FIG. 18. The power supply circuit 1903 can be housed at least partially inside at least one of the candle holder 1970 or the candle body 1900, and can be adapted to provide electrical power to the at least one flame simulator 100.

Each flame simulator 100 is located partially inside the candle body 1900 and comprises a light beam source 104, a flame screen 114, a light beam mover 108, and a range limiter 106. The light beam source 104 can be adapted to project a movable beam of light 116. Examples of light beam sources 104 are shown in the previous drawings and disclosed in the above description.

The flame screen 114 is arranged with respect to the light beam source 104 so that, when the light beam source 104 projects the movable beam of light 116, at least a portion of the movable beam 116 of light strikes the flame screen 114. The light beam mover 108 is operatively associated with the light beam source 104 and adapted to impart movement to at least part of the light beam source 104. Examples of light beam movers 108 are shown in the previous drawings and disclosed in the above description. Those light beam movers 108, or alternatives thereto, can be configured to fit within a housing 1900 that resembles a narrow candle stick. The light beam mover 108 of FIG. 19 can comprise an air mover (e.g., as shown in FIG. 7) adapted to generate at least one air current that causes movement of at least part of the light beam source 104. Alternatively, or in addition, the light beam mover 108 can comprise a motor and a mechanical coupling and/or magnetic coupling from the motor to at least part of the light beam source 108 (e.g., as shown in FIG. 4, 5 or 6).

The extension 412, 512, 612 and/or 712 of FIGS. 4, 5, 6 and 7, respectively, can be configured long enough to extend from the light beam source 104 to a low position in the candle body 1900 or to an even lower position in the candle holder 1970 so that other components of the light beam mover 108 can be located where there is more space to accommodate them.

The range limiter 106 can be operatively associated with the light beam source 104 and adapted to limit movement of the light beam source 104 and the movable beam 116 of light so that the movable beam 116 of light, when being projected, strikes at least a portion of the flame screen 114 and causes illumination of the flame screen 114 by the beam 116 of light to resemble a flame.

The power supply 1903 can include a solar panel 1966 (e.g., the solar panel 1866 of FIG. 18) The solar panel 1966 can be adapted to convert light energy into electrical energy and can be located on the candle holder 1970.

The energy storage battery of the power supply 1903 can be adapted to store electrical power from the solar panel 1966 and supply the electrical power to each flame simulator 100 when each flame simulator is activated.

The light beam source 104 can include a light source (e.g., any of the light sources 120 shown in the previous drawings and disclosed in the above description) adapted to generate light and at least one light conditioner (e.g., any of the light conditioners 122 shown in the previous drawings and disclosed in the above description) adapted to produce the beam 116 of light using light from the light source 120 and to direct the light at the flame screen 114. The light beam mover 108 can be operatively associated with the light source 120 to impart movement to the light source 120. The light conditioner(s) 122 can be adapted to remain stationary when the light beam mover 108 imparts movement to the light source 120.

Alternatively, the light beam mover 108 can be operatively associated with the light beam source 104 and adapted to impart movement to part of the light beam source 104 or the entire light beam source 104.

The flame simulator of FIG. 19 can comprise a flame simulator body (e.g., an inner core 442 or ring 431 of FIG. 4, an inner core 542 or ring 531 of FIG. 5, an inner core 642 or ring 631 of FIG. 6, or an inner core 742 or ring 731 of FIG. 7). An anchor (e.g., anchor 430, 530, 630, 730, 930, 1030, 1130 or 1330 shown in FIGS. 4, 5, 6 7, 9, 10, 11 and 13, respectively) can be fixed to the flame simulator body. A ball-and-socket coupling (examples of which are shown in the previous drawings and disclosed in the above description) can be provided between the anchor and the light beam source 104 of FIG. 19. Alternatively, the light beam source 104 of FIG. 19 can be connected to the anchor by a connector (e.g., connector 438, 538, 638, 738, 838 or 938 of FIGS. 4, 5, 6 7, 8 and 9, respectively). As described above, the ball-and-socket coupling, anchor, and/or the connector can comprise at least part of the range limiter 106. Other range limiting mechanisms can be used in addition to, or as an alternative to, the ball-and-socket coupling or the other range limiters 106 described above.

Figure 20:
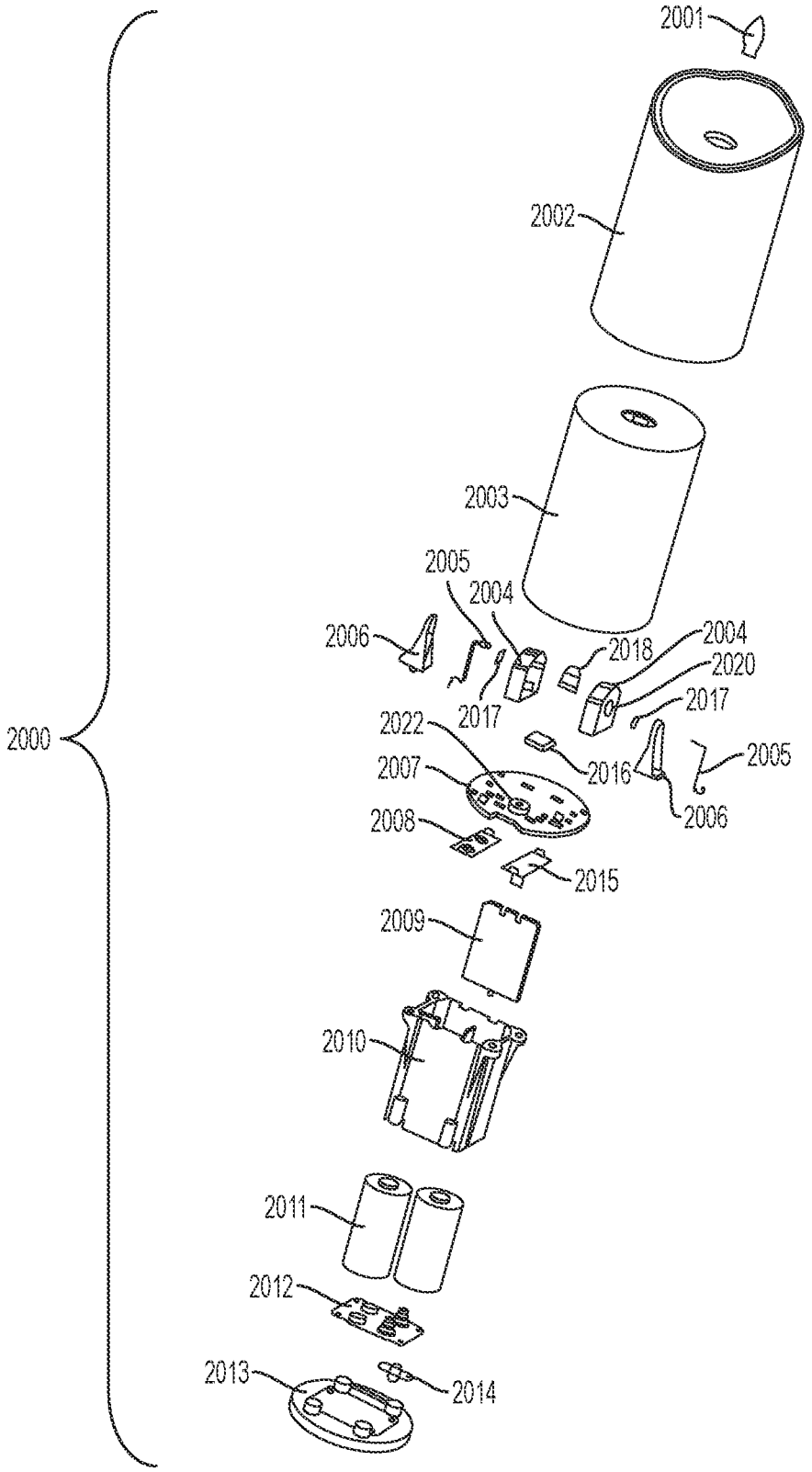
FIG. 20 is an exploded view of an imitation candle comprising a flame simulator according to an embodiment of the present invention.

FIG. 20 shows an exploded view of an example of an imitation candle comprising a flame simulator 2000 according to an embodiment of the present invention. The imitation candle shown in FIG. 20 includes an outer body 2002 and flame screen 2001. The outer body 2002 provides a decorative, aesthetic structure that is visible when the shown elements are assembled and configured to resemble a candle. The flame screen 2001 extends up and through an opening in the top of the outer body 2002 so that the flame screen 2001 is visible when the imitation candle is assembled. The flame screen 2001 is configured to be stationary and can include the features described throughout this application. The outer body 2002 is shaped to correspond with a shape of housing 2003. The housing 2003 is positioned within the outer body 2002 such that when assembled, the housing 2003 is not visible to a user. FIG. 20 shows the outer body 2002 and the housing 2003 having corresponding cylindrical shapes. Other shapes for each structure could be employed, e.g., a cube-shaped outer body with a cube-shaped housing or a cylindrical-shaped outer body with a rectangular-prism-shaped housing as well as other shapes. The housing 2003 can provide a structure to protect the light beam mover and light beam source described herein.

In some examples, the outer body 2002 can comprise at least one of paraffin wax, plastic, silicon, or other material that can cause the candle to resemble a conventional candle that includes a flame. The outer body 2002 can be shaped such that at least a portion of its top edge can extend at least as high (e.g., higher) in a vertical direction than the flame screen 2001 when the imitation candle is assembled. FIG. 20 shows the outer body 2002 having a top edge that includes uneven regions to simulate variations in candle-top melting. Other configurations of the top edge can be employed. The rear portion of the top edge of outer body 2002 is configured to be at least as high (or higher) than the flame screen 2001 so that the flame screen 2001 is not visible from behind when the outer body 2002 is viewed horizontally from behind (e.g., viewed from behind, horizontally across a room).

In the embodiment shown in FIG. 20, the light beam mover comprises a magnetic field generator adapted to produce a magnetic field that varies over time and causes as least part of a light beam source 2018 to move. The light beam source 2018 can use a light emitting diode ("LED"), an incandescent bulb, or any other source of light capable of emitting light with a quality, intensity, shape and/or color that mimics a flame (e.g., a candle flame) when the beam strikes the flame screen 2001. The light beam source 2018 emits a beam through the opening of the housing 2003 and the opening of the outer body 2002 (which are axially aligned when the candle is assembled). In some embodiments, the light beam source 2018 includes a single LED. In other embodiments, the light beam source 2018 includes a plurality of LEDs, e.g., two LEDs. In some such embodiments where the light beam source 2018 includes a plurality of LEDs, the LEDs can be mounted side-by-side and configured to randomly dim and brighten the beam emitted from the respective LEDs to illuminate different portions of the flame screen 2001. In such examples, the different portions illuminated by the multiple LEDs can be overlapping such that when the quality, intensity, position, or color of a first LED and a second LED are varied, the simulated flame appears to move and mimic the visual appearance of a conventional candle flame.

The light beam source 2018 is positioned within or between two complementary structures 2004 that, when combined, form a light beam housing body. In some examples, the light beam housing body can include range limiter structures 2017 operatively associated with the light beam source 2018. The range limiter structures 2017 can include a pair of circular torsion springs adapted to limit movement of the light beam source 2018. The range limiter structures 2017 can be arranged in openings 2020 (only one shown) in each complementary structure 2004 so that the range limiter structures 2017 engage the respective complementary structure 2004 and the structure 2006 in such a way that they limit movement of complementary structure 2004 with respect to structure 2006 (e.g., via spring biasing). In some cases, the light beam housing body includes projections or protrusions that provide an abutment or physical structure that obstructs or prevents the light beam source 2018 from moving in a particular direction, for example, limits the amount of rotation of the light beam source 2018 around an axis defined by elements 2005. Other range limiter structures described herein can also be used in order to ensure that the movable beam of light, when being projected, strikes at least a portion of the flame screen 2001 and causes illumination of the flame screen 2001 by the beam of light to resemble a flame.

Elements 2005 define an axle that can be used to facilitate movement of the light beam source 2018. Elements 2005 can extend through respective ones of the complementary structures 2004 of the light beam source housing and be operatively connected to light beam source 2018. The elements 2005 can be coupled to the light beam source 2018 such that the light beam source 2018 and/or light beam source housing can rotate around the axle created by elements 2005 in response to a change in a magnetic field, as described below. The elements 2005 can be housed in the structures 2006 which can be configured to serve as a base for anchoring the light beam source 2018 to a printed circuit board 2007 or other structure.

A magnetically responsive element 2016 (e.g., an earth magnet) can be connected to or otherwise associated with the light beam source 2018 (e.g., mounted to the light beam source housing) so that when the magnetic field varies, a force is applied to the magnetically responsive element 2016 and causes the magnetically responsive element 2016 to move. By providing a suitable coupling between the magnetically responsive element 2016 and the light beam source 2018, movement of the magnetically responsive element 2016 can be transferred directly or indirectly to the light beam source 2018 and cause the light beam source 2018 or a component thereof to move (e.g., wiggle or rotate). This movement, in turn, causes the beam emitted from light beam source 2018 to move (e.g., wiggle).

In some cases, the magnetic field generator can comprise an electrical coil 2022 which is electrically connected to a source of varying electrical voltage. Alternatively, multiple coils can be utilized. The varying electrical voltage creates variations in electrical current in each coil, and the varying current produces a varying magnetic field. The varying magnetic field acts on the magnetically responsive element 2016 and forces the light beam source 2018 or a component thereof to move (e.g., wiggle). This movement, in turn, causes the beam emitted from the light beam source 2018 to move (e.g., wiggle). The number of windings in the coil and the magnitude and variations of the voltage are selected so that the variations and strength of the magnetic field cause the light beam source 2018 to move (e.g., wiggle) with a frequency, speed and range (limited by the range limiter) that causes the illumination of the flame screen 2001 by the beam to resemble a flame moving (or dancing) in response to air currents.

Circuitry for producing the varying electrical voltage can be housed in printed circuit board 2007 (and/or 2009) or alternatively can be placed on other logic devices exposed on printed circuit board 2007 (and/or 2009) or other structure inside the housing 2003. The varying electrical voltage can be cyclic (repeating) or can be random. The varying electrical voltage can be a sinusoidal voltage, a square wave, a pulse-modulated voltage, an amplitude-modulated voltage, a frequency-modulated voltage or other output voltage variations that produce a suitable variation in magnetic field and that result in suitable wiggling of the light beam source 2018 (or a component thereof). The circuitry can comprise the logic and source code to provide the signals and direction to perform at least one of the following steps: turning the power on and off to the light beam source 2018 or magnetic field generator, controlling oscillators, controlling a timer (e.g., for automatic cut-off after a defined period of time), directing and varying the intensity of the beam emitted from the light beam source 2018, directing and varying the color of the beam emitted from the light beam source 2018, directing and varying the projection of the beam emitted from the light beam source 2018, directing and varying the voltage supplied to the magnetic field generator; directing voltage supplied in response to external stimulus (e.g., blowing into a microphone), and other actions. The printed circuit board 2007 (and/or 2009) can include varied configurations of pins, circuits, and connectors necessary to carry out the different functions of the flame simulator.

The base of the housing 2003 can include a battery compartment which holds one or more batteries 2011 that store electrical power (and can serve as the power supply) for the flame simulator. The battery compartment can comprise the housing 2010, elements 2012, 2008, and 2015 that provide the respective leads to facilitate the extracting of power from the batteries 2011. The batteries 2011 can be rechargeable, or alternatively, can be disposable and can include all conventional sized shaped batteries, e.g., A, AA, AAA, C, D, and others. The batteries 2011 are operatively (e.g., electrically) coupled to a printed circuit board 2007 (and/or 2009) and light beam source 2018 to provide power to the printed circuit board 2007 (and/or 2009) and light beam source 2018 to produce the varying electrical voltage and corresponding flame effects described above.

Alternatively, the base of the housing 2003 can include a power converter which receives AC household power via a power cord (not shown) and converts it to: (1) a DC voltage to power the light source 2018 and (2) a suitable AC or varying DC voltage to power the light beam mover. In some embodiments, the printed circuit board 2007 (and/or 2009) and magnetically responsive element 2016 can be configured to generate the desired magnetic field variations using household AC power, without any switching or conversion of the AC signal (other than to provide DC power to a light source).

Insulated wires or other suitable electrical conductors 2008, 2012, 2015 can extend from the base and power switch 2014 to the light beam source 2018 and can electrically connect the power supply 2011 to the light beam source 2018. The wires can be flexible so as to allow movement (e.g., wiggling) of the entire light beam source 2018 (or one or more components thereof).

The flame simulators disclosed above are not limited to stand-alone candles. They can be incorporated into other structures that benefit from the appearance of a simulated flame and which can be battery-powered or powered by household AC power. Examples of such structures include lanterns, coach lights, dock lights, deck lights, patio lights, candelabra, chandelier, lights surrounding a swimming pool or spa, and/or into a simulated light bulb. The examples of candle bodies/housings shown in the drawings are somewhat cylindrical and candle-like, but other shapes of candle bodies/housings can be implemented to mimic candles having other shapes or other flame-bearing objects.

In addition, any of the foregoing flame simulators 100 or others can be provided with remote control circuitry that receives user inputs (wirelessly or otherwise) from a remote controller and controls the flame simulator based on those inputs. The remote control circuitry and remote controller can be configured to implement any one or more of the modes of operation described above in connection with a user interface, or other modes of operation.

The foregoing flame simulators also can be combined with one or more scent emitters and/or replaceable scent cartridges. Each scent emitter can be configured to emit a desired scent whenever the flame simulator 100 is operating, or can be configured to emit a scent independently of the on-or-off status of the flame simulator 100.

In some cases, the flame simulators also can include a sensor that can be configured to detect whether a person is blowing into the sensor to mimic the blowing out of a candle. In some cases, the sensor comprises a microphone. The sensor can be operatively connected to the power supply of the flame simulator such that upon detection of an air current of sufficient magnitude, e.g., a person blowing into the sensor, the sensor can transmit or otherwise interrupt a signal disconnecting the power to the light beam source and as a result, turning off the candle. In some embodiments, the sensor can be configured such that different responses by the light source are shown on the flame screen based on the magnitude of the air current directed at the sensor. For example, a forceful, burst of air like one uses to blow out traditional candles can be a first magnitude that is sufficiently high to cut the light beam source off (mimicking blowing out a candle). A slow, more drawn out stream of air of a second magnitude, which is lower than the first magnitude, may provide a signal to the flame simulator that causes the light beam source and/or light beam mover to adjust and provide a more intense flickering of the light beam, for example, to simulate a person blowing a conventional candle's flame that is not hard enough to put out the candle.

Although the illustrated examples of the flame simulator 100 include a flame screen 114 that can be kept stationary, it is understood that the flame simulator can be implemented with a movable flame screen 114. Examples of movable flame screens are described in some of the patents identified in the Background of the Invention.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A flame simulator comprising:

a housing;

a light beam source adapted to project a light beam, wherein the light beam source comprises a light source adapted to produce light and a light conditioner adapted to act on the light from the light source to produce the light beam with a color, size and shape that mimics a flame when the light beam strikes a flame screen;

the flame screen arranged with respect to the light beam source so that, when the light beam source projects the light beam, a portion of the light beam strikes the flame screen, wherein the flame screen is stationary relative to the housing;

a light beam mover operatively associated with the light beam source and adapted to impart movement to a movable portion of the light beam source relative to the flame screen; and a range limiter operatively associated with the movable portion of the light beam source so that the light beam, when projected, always strikes a portion of the flame screen and causes illumination of the flame screen by the light beam, wherein the range limiter is configured so as to allow the light beam to move laterally in addition to, or in combination with, vertical movement of the light beam on the flame screen.

2. The flame simulator of claim 1, wherein the light beam mover comprises a motor and a mechanical coupling from the motor to the movable portion of the light beam source.

3. The flame simulator of claim 1, wherein the light beam mover comprises a magnetic field generator adapted to produce a magnetic field that varies and causes the movable portion of the light beam source to move.

4. The flame simulator of claim 1, wherein the light beam mover comprises an air mover adapted to move air to cause movement of the movable portion of the light beam source.

5. The flame simulator of claim 1, wherein the light beam mover and the range limiter are configured so that movement of the light beam by the light beam mover causes changes in an angle of illumination and a position of illumination of the flame screen.

6. The flame simulator of claim 5, wherein the light beam mover and the range limiter are configured so that the changes in the angle of illumination and the position of illumination of the flame screen result in changes to the shape of the illumination of the flame screen.

7. The flame simulator of claim 1, wherein the light beam mover is configured to move the light source while the light conditioner remains stationary.

8. The flame simulator of claim 1, wherein the light beam mover is configured to move the light conditioner while the light source remains stationary.

9. The flame simulator of claim 1, wherein the light beam mover is configured to move the light conditioner and the light source.

10. The flame simulator of claim 1, wherein the shape of the flame screen and a range of angles of the light beam with respect to the flame screen are configured so that the illumination of the flame screen by the light beam results in rounded, flame-shaped light projection on the flame screen.

11. The flame simulator of claim 1, wherein the light beam mover and the range limiter are configured so that movement of the light beam source in response to the light beam mover causes changes in the shape and position of illumination of the flame screen by the light beam to mimic movement of a flame exposed to ambient air currents.

12. The flame simulator of claim 1, wherein the light beam has a shape, an intensity, and a color that result in a candle flame-mimicking illumination of the flame screen.

13. The flame simulator of claim 1, wherein the light beam source is adapted to produce the light beam with a correlated color temperature in a range between 1,800 Kelvin and 1,900 Kelvin.

14. The flame simulator of claim 1, wherein the light beam source is adapted to produce the light beam with a correlated color temperature in a range between 1,650 Kelvin and 2,300 Kelvin.

15. The flame simulator of claim 1, wherein the housing resembles a candle.

16. The flame simulator of claim 15, wherein the flame screen projects upwardly from an upper surface of the housing.

17. The flame simulator of claim 16, wherein the light beam source is located in the housing and no higher than the upper surface of the housing so that the light beam source is not visible when the housing is viewed from a location that is laterally separated from the housing.

18. The flame simulator of claim 1, wherein:

the range limiter comprises an anchor fixed to the housing and a connector by which the light beam source is connected to the anchor; and the anchor extends downwardly from an upper wall of the housing.

19. The flame simulator of claim 18, further comprising a ball-and-socket coupling between the light beam source and the anchor.

20. The flame simulator of claim 19, wherein the ball-and-socket coupling constitutes at least part of the range limiter.

21. The flame simulator of claim 1, wherein:

the range limiter comprises an anchor fixed to the housing and a connector by which the light beam source is connected to the anchor;

the anchor comprises a crossbar;

the connector is detachably attached to the light beam source to retain the light beam source coupled with the crossbar; and a clearance between the crossbar and an assembly comprises the connector and the light beam source is configured to limit the movement of the light beam source relative to the crossbar.

22. The flame simulator of claim 1, wherein:

the range limiter comprises an anchor fixed to the housing;

the anchor comprises a crossbar; and the light beam source comprises a light beam source frame and a connector configured for coupling with the light beam source frame to form a passage sized to accommodate the crossbar within the passage.

23. The flame simulator of claim 22, wherein the connector comprises one or more barbs configured to resist decoupling of the connector from the light beam source frame when the connector is coupled with the light beam source frame.

24. An imitation candle comprising:

a candle body that, when resting upright on a surface, visually resembles a wax candle; and a flame simulator located partially inside the candle body, wherein the flame simulator comprises:

a light beam source adapted to project a light beam, wherein the light beam source comprises a light source adapted to produce light and a light conditioner adapted to act on the light from the light source to produce the light beam with a color, size and shape that mimics a flame when the light beam strikes a flame screen;

the flame screen arranged with respect to the light beam source so that, when the light beam source projects the light beam, a portion of the light beam strikes the flame screen, wherein the flame screen is stationary relative to the candle body;

a light beam mover operatively associated with the light beam source and adapted to impart movement to a movable portion of the light beam source relative to the flame screen; and a range limiter operatively associated with the movable portion of the light beam source so that the light beam, when projected, always strikes a portion of the flame screen and causes illumination of the flame screen by the light beam, wherein the range limiter is configured so as to allow the light beam to move laterally in addition to, or in combination with, vertical movement of the light beam on the flame screen.

25. The imitation candle of claim 24, wherein the light beam mover comprises a motor and a mechanical coupling from the motor to the movable portion of the light beam source.

26. The imitation candle of claim 24, wherein the light beam mover comprises a magnetic field generator adapted to produce a magnetic field that varies and causes the movable portion of the light beam source to move.

27. The imitation candle of claim 24, wherein the light beam mover comprises an air mover adapted to move air to cause movement of the movable portion of the light beam source.

28. The imitation candle of claim 24, wherein:

the candle body comprises an upper surface;

the flame screen is located at the upper surface and extends upwardly from the upper surface; and the imitation candle further comprises a second flame simulator arranged so that a flame screen of the second flame simulator is laterally spaced apart from the flame screen of the flame simulator, to simulate a candle having multiple burning wicks.

29. The imitation candle of claim 24, wherein the light beam mover and the range limiter are configured so that movement of the light beam in response to the light beam mover causes changes in illumination of the flame screen that mimic movement of a flame exposed to ambient air currents.

30. The imitation candle of claim 29, wherein the light beam mover and the range limiter are configured so that movement of the light beam in response to the light beam mover causes changes in shape and position of illumination of the flame screen by the light beam.

31. The imitation candle of claim 24, wherein the light beam has a shape, an intensity, and a color that result in a candle flame-mimicking illumination of the flame screen.

32. An imitation candle comprising:

a candle body that visually resembles a wax candle;

a candle holder adapted to support the candle body; and a flame simulator located partially inside the candle body, wherein the flame simulator comprises:

a light beam source adapted to project a light beam, wherein the light beam source comprises a light source adapted to produce light and a light conditioner adapted to act on the light from the light source to produce the light beam with a color, size and shape that mimics a flame when the light beam strikes a flame screen;

the flame screen arranged with respect to the light beam source so that, when the light beam source projects the light beam, a portion of the light beam strikes the flame screen, wherein the flame screen is stationary relative to the candle body;

a light beam mover operatively associated with the light beam source and adapted to impart movement to a movable portion of the light beam source relative to the flame screen; and a range limiter operatively associated with the movable portion of the light beam source so that the light beam, when projected, always strikes a portion of the flame screen and causes illumination of the flame screen by the light beam, wherein the range limiter is configured so as to allow the light beam to move laterally in addition to, or in combination with, vertical movement of the light beam on the flame screen; and a power supply housed at least partially inside at least one of the candle holder or the candle body, and adapted to provide electrical power to the flame simulator.

33. The imitation candle of claim 32, wherein the light beam mover comprises a motor and a mechanical coupling from the motor to the movable portion of the light beam source.

34. The imitation candle of claim 32, wherein the light beam mover comprises a magnetic field generator adapted to produce a magnetic field that varies and causes the movable portion of the light beam source to move.

35. The imitation candle of claim 32, wherein the light beam mover comprises an air mover adapted to move air to cause movement of the movable portion of the light beam source.

36. The imitation candle of claim 32, wherein the power supply includes a solar panel adapted to convert light energy into electrical energy, and an energy storage battery adapted to store electrical power from the solar panel and supply the electrical power to the flame simulator when the flame simulator is activated.

37. The imitation candle of claim 36, wherein the solar panel is located on the candle holder.

* * * * *